US010135185B2

(12) United States Patent
Akagi

(10) Patent No.: US 10,135,185 B2
(45) Date of Patent: Nov. 20, 2018

(54) CONNECTOR UNIT

(71) Applicant: Yazaki Corporation, Tokyo (JP)

(72) Inventor: Yosuke Akagi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/882,931

(22) Filed: Jan. 29, 2018

(65) Prior Publication Data

US 2018/0287297 A1 Oct. 4, 2018

(30) Foreign Application Priority Data

Mar. 29, 2017 (JP) ..... 2017-064557

(51) Int. Cl.

| | |
|---|---|
| ***H01R 13/62*** | (2006.01) |
| ***H01R 13/629*** | (2006.01) |
| ***H01R 24/20*** | (2011.01) |
| ***H01R 24/28*** | (2011.01) |
| *H01R 107/00* | (2006.01) |

(52) U.S. Cl.

CPC ... *H01R 13/62938* (2013.01); *H01R 13/6295* (2013.01); *H01R 24/20* (2013.01); *H01R 24/28* (2013.01); *H01R 2107/00* (2013.01)

(58) Field of Classification Search

CPC ..... H01R 13/62938; H01R 13/6295; H01R 13/629885

See application file for complete search history.

(56) References Cited

U.S. PATENT DOCUMENTS

| | | | | |
|---|---|---|---|---|
| 8,840,409 | B2 * | 9/2014 | Ikeda | H01R 13/62938 439/157 |
| 9,472,895 | B2 * | 10/2016 | Kataoka | H01R 13/62938 |
| 9,564,710 | B2 * | 2/2017 | Ebihara | H01R 13/62938 |
| 9,972,937 | B2 * | 5/2018 | Akagi | H01R 13/516 |
| 10,008,806 | B2 * | 6/2018 | Matsunaga | H01R 13/62955 |

FOREIGN PATENT DOCUMENTS

JP 2003-17190 A 1/2003

* cited by examiner

*Primary Examiner* — Xuong Chung Trans
(74) *Attorney, Agent, or Firm* — Kenealy Vaidya LLP

(57) ABSTRACT

Provided is a connector unit which can prevent damage to respective parts during rotation of a lever member. A fitting portion of a female outer housing fits with a to-be-fitted portion of a male outer housing, wherein timing of the fitting is after timing of insertion of a guide projection into a guide groove and timing of releasing of a restriction arm by a release projection. Fitting of the fitting portion with the to-be-fitted portion allows an operator to feel a change in force required for operation during moving the male outer housing and the female outer housing toward each other. By rotating the lever member after the operator felt the change in the force, damage to the guide projection and the restriction arm and such can be prevented.

12 Claims, 26 Drawing Sheets

CONNECTOR UNIT

CROSS REFERENCE TO RELATED APPLICATION

The priority application Japanese Patent Application No. 2017-064557 upon which this patent application is based is hereby incorporated by reference.

BACKGROUND OF THE INVENTION

Field of the Invention

The present invention relates to a connector unit having a first housing, a second housing and a lever member.

Description of the Related Art

Conventionally, a lever-type connector (connector unit) arranged to fit a female connector housing (first housing) with a male connector housing (second housing) by a lever (lever member) has been proposed, as disclosed for example in Japanese Patent Application Publication No. 2003-17190. A lever-type connector disclosed in Japanese Patent Application Publication No. 2003-17190 is arranged such that a projected cam pin (a guide projection) formed at a male connector housing is arranged to be guided into a cam groove (a guide groove) of the lever attached to a female connector housing, so that by rotating the lever the connector housings are moved toward each other and fit each other.

SUMMARY OF THE INVENTION

However, such configuration in which the connector housings are moved toward each other by the rotation of the lever as disclosed in Japanese Patent Application Publication No. 2003-17190, has a drawback that, when the lever is rotated before the cam pin reaches to a position at which the cam pin can be guided by the cam groove, the guiding action may fail and may cause damage to the cam pin and such. To address this problem a restriction means can be provided for restricting the lever from rotating until the cam pin reaches to a predetermined position. However, since the connector housing is generally made of resin, when large rotation force is applied the restriction means can be damaged and the lever can be rotated, even if the rotation is under restriction.

An object of the present invention is to provide a connector unit which can prevent damage to respective parts/components during rotation of a lever member.

To achieve the above-mentioned object, the present invention according to a first aspect provides a connector unit including a tubular first housing, a second housing arranged to be housed in the first housing, and a lever member attached to an outer side of the first housing and arranged to fit the first housing with the second housing, wherein the lever member includes a pair of plate portions provided so as to sandwich the first housing, and a connecting portion connecting the pair of plate portions and arranged to be latched onto the first housing, wherein the plate portion includes an axis portion to be pivotally supported to the first housing, a guide groove for guiding the second housing, and a restriction arm arranged to abut on the first housing to restrict rotation of the lever member around the axis portion, wherein an outer face of the second housing is provided with a guide projection arranged to be guided by the guide groove, a release projection which releases the restriction arm by deforming the restriction arm outward, and a fitting portion arranged to be fitted with a to-be-fitted portion of the first housing, and wherein, during the second housing is being housed in the first housing, the guide projection is inserted to a guidable position of the guide groove, and after the restriction arm is released by the release projection, the fitting portion of the second housing is fitted with the to-be-fitted portion of the first housing.

To achieve the above-mentioned object, the present invention according to a second aspect provides the connector unit as described above, wherein the first housing is formed into a quadrangular tube-like shape with a pair of side face portions arranged to pivotally support the plate portions, a side face portion arranged to latch the connecting portion, and a side face portion provided with the to-be-fitted portion.

To achieve the above-mentioned object, the present invention according to a third aspect provides the connector unit as described above, wherein the plate portion is provided with a detection arm, wherein the detection arm is arranged to extend along an extending direction of the tubular first housing in a state before the connecting portion is latched onto the first housing, and is arranged to be deformed inwardly when the connecting portion is latched onto to the first housing, and wherein the lever member is arranged such that, in the state before the connecting portion is latched onto the first housing, when an inward force is applied to the detection arm, the connecting portion is rotated so as to be latched onto the first housing.

To achieve the above-mentioned object, the present invention according to a fourth aspect provides the connector unit as described above, wherein a detection projection is provided on an outer face of the first housing, wherein the detection projection is arranged to deform the detection arm outward in the state before the connecting portion is latched onto the first housing, wherein the detection projection includes a slanted face slanted outward as it gets toward a distal end side of the detection arm from a proximal end side of the detection arm, wherein the lever member is arranged such that, in the state before the connecting portion is latched onto the first housing, when the inward force is applied to the detection arm, the detection arm is guided by the slanted face and goes over the detection projection, thereby allowing the lever member to rotate.

To achieve the above-mentioned object, the present invention according to a fifth aspect provides the connector unit as described above, wherein at least one of the first housing and the second housing is a tubular outer housing having a housing portion for housing an inner member, wherein a side face portion of the outer housing is provided with a detection opening through which the housing portion can be seen from outside, wherein a concaved or convexed detection portion is provided on an outer face of the inner member, wherein the inner member is arranged to be latched onto the outer housing when a housing amount within the outer housing becomes equal to a proper housing amount, and wherein the detection portion is arranged such that, when the housing amount is less than the proper housing amount, the detection portion can be seen through the detection opening, whereas when the housing amount becomes equal to the proper housing amount, the detection portion is hidden by the side face portion of the outer housing and cannot be seen.

According to the first aspect, fitting of the fitting portion of the second housing with the to-be-fitted portion of the first housing allows an operator to feel the change in force required for operation (i.e., the change in response) during moving the first housing and the second housing toward each other and housing the second housing in the first housing. At this time, the timing of the fitting is after the timing at which the guide projection is inserted to the guidable position in the guide groove and the timing at which the restriction arm is released by the release projection (that is, at the same time as or after the insertion timing and the release timing). Consequently, the operator can rotate the lever member after he felt the change in response (change in feeling), thereby preventing the damage to the respective parts such as the guide projection and the restriction arm. In other words, the operator can recognize by the change in response that the lever member has come to the suitable state for rotation. Here, one of the fitting portion and the to-be-fitted portion may be convexed, while another one of the fitting portion and the to-be-fitted portion may be concaved or a hole.

According to the second aspect, since the four side face portions of the quadrangular tube-like shaped first housing each has its function, the respective side face portions can be downsized and can have simple construction.

According to the third aspect, the connecting portion is latched onto the first housing and the detection arm is deformed inward, so the overall size (external dimensions) of the connector housing will change in accordance with whether or not the connecting portion is latched. Consequently, when trying to insert the connector housing through the opening of the object to be attached, the insertion is permitted if the connecting portion is latched, whereas the insertion is prohibited if the connecting portion is not latched because the detection arm is caught by an inner edge of the opening.

Since the detection arm extends along the extending direction of the first housing, when trying to insert the connector unit through the opening along the extending direction, the inward force is likely to be applied to the detection arm, thus it is easy to deform the detection arm inward and rotate the lever member. Consequently, when attaching the connector unit in the provisional fit state (i.e., the state in which the connecting portion is not latched onto the first housing) to the object to be attached, the damage to the detection arm can be prevented. Furthermore, by inserting the connector unit in the provisional fit state through the opening, the lever member can be rotated, and the connecting portion can be latched onto the first housing, thereby bringing the connector unit into the fully fitted state (i.e., the state in which the connecting portion is latched onto the first housing).

According to the fourth aspect, the detection projection for deforming the detection arm outward is provided with the slanted face, making it easy to rotate the lever member when the inward force is applied to the detection arm.

According to the fifth aspect, it can be determined that the housing is not sufficient if the detection portion can be seen through the detection opening, whereas it can be determined that the housing is sufficient if the detection portion cannot be seen. At this time, a jig may be inserted in the detection opening to determine whether the detection portion is in the state in which it can be seen or not, according to the depth of insertion.

DETAILED DESCRIPTION OF THE INVENTION

First Invention

Figure 1:
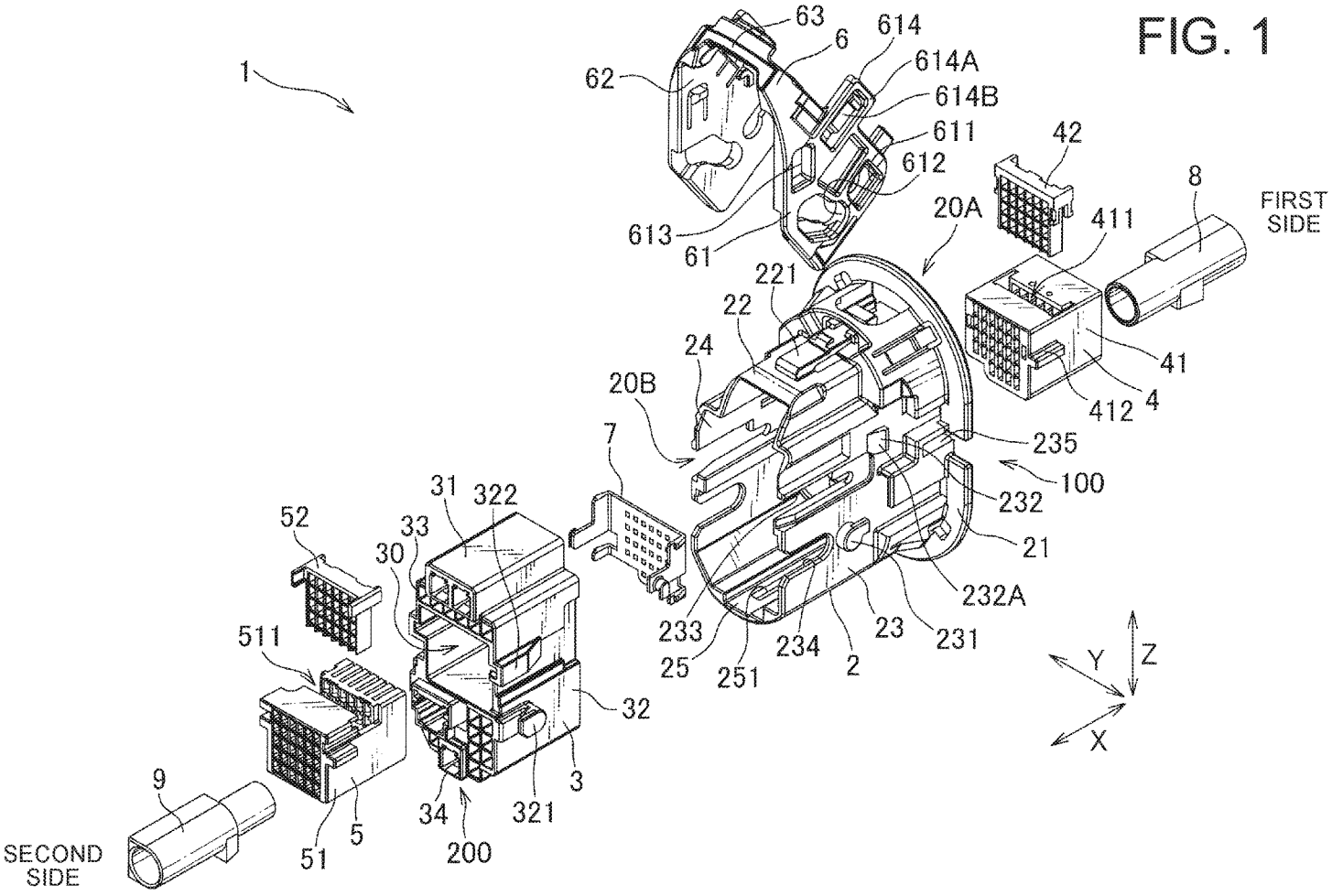
FIG. 1 is an exploded perspective view showing a connector unit according to an embodiment of the first invention.
Figure 2:
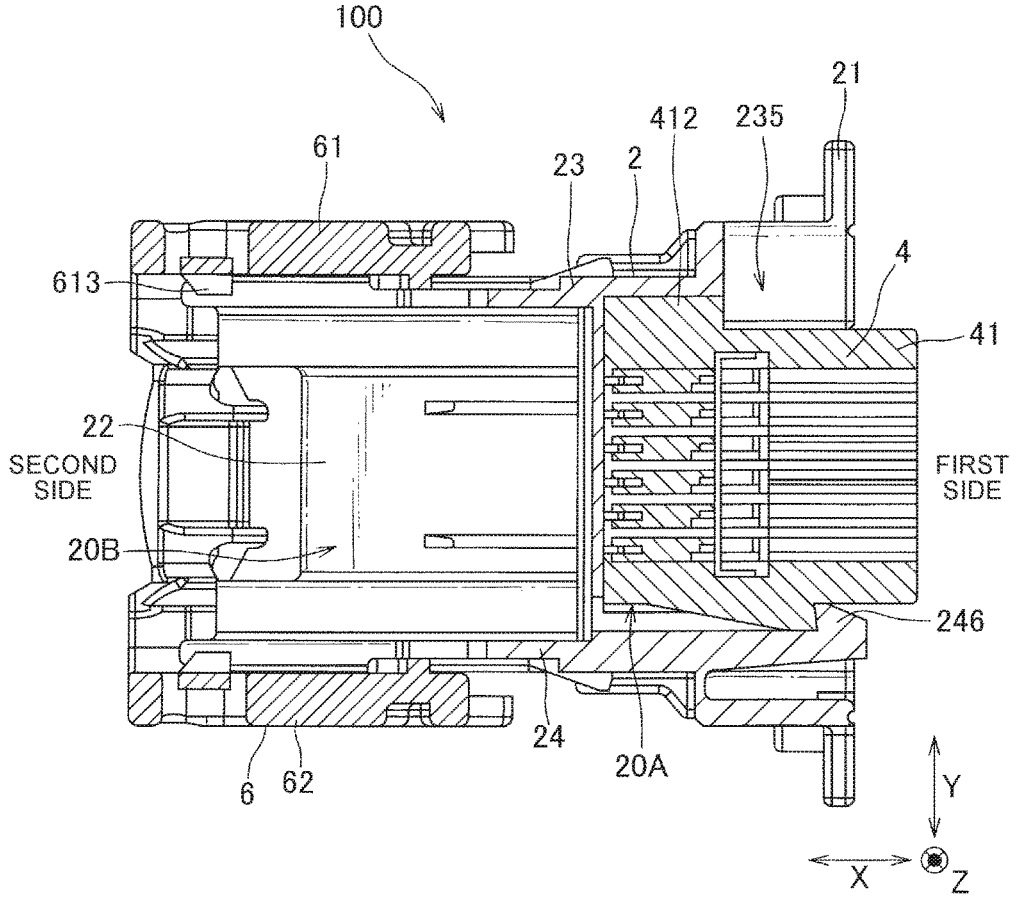
FIG. 2 is a cross-sectional view of the connector unit with an inner member housed in a first housing of the connector unit.
Figure 3A:
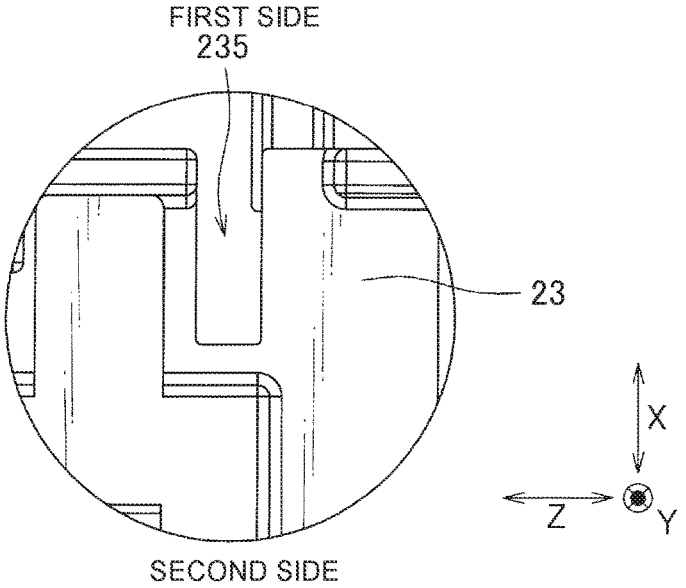
FIG. 3A is a partial side view illustrating a state in which a housing amount of the inner member within the first housing is equal to a proper housing amount.
Figure 3B:
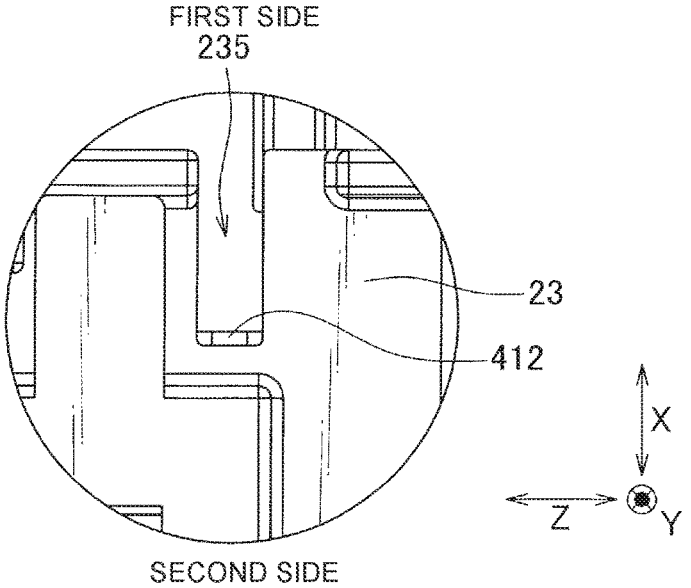
FIG. 3B is a partial side view illustrating a state in which the housing amount of the inner member within the first housing is less than the proper housing amount.
Figure 4A:
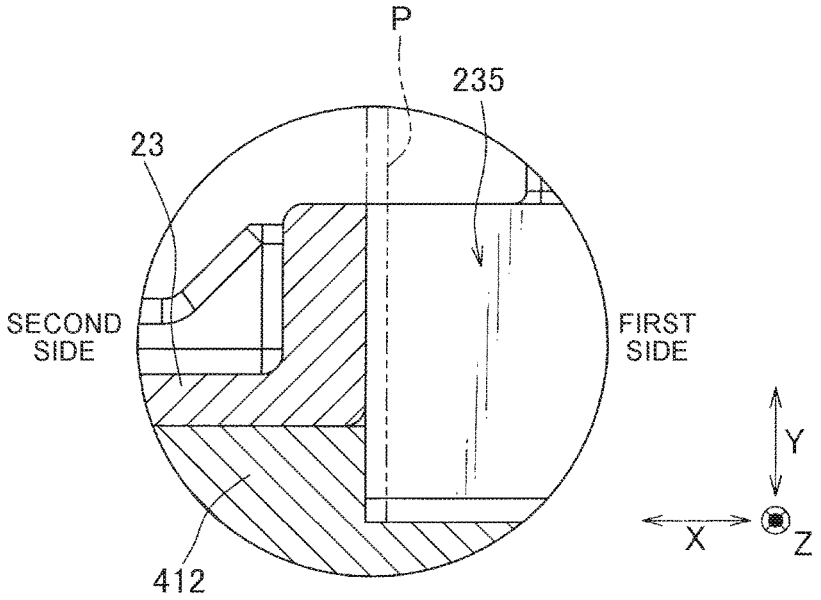
FIG. 4A is a partial cross-sectional view illustrating a state in which the housing amount of the inner member within the first housing is equal to the proper housing amount.
Figure 4B:
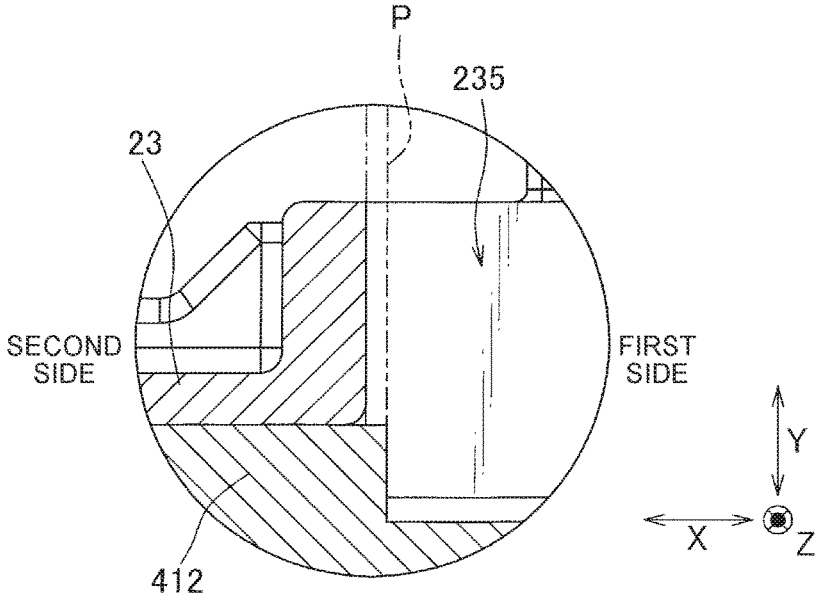
FIG. 4B is a partial cross-sectional view illustrating a state in which the housing amount of the inner member within the first housing is less than the proper housing amount.
Figure 5A:
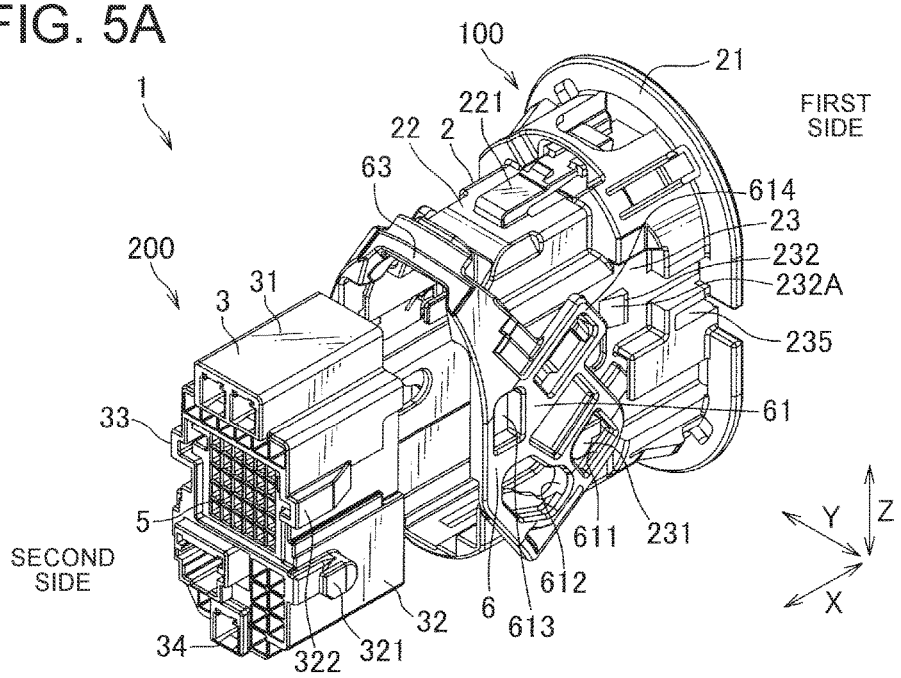
FIG. 5A is a perspective view of the connector unit in an initial state of assembling.
Figure 5B:
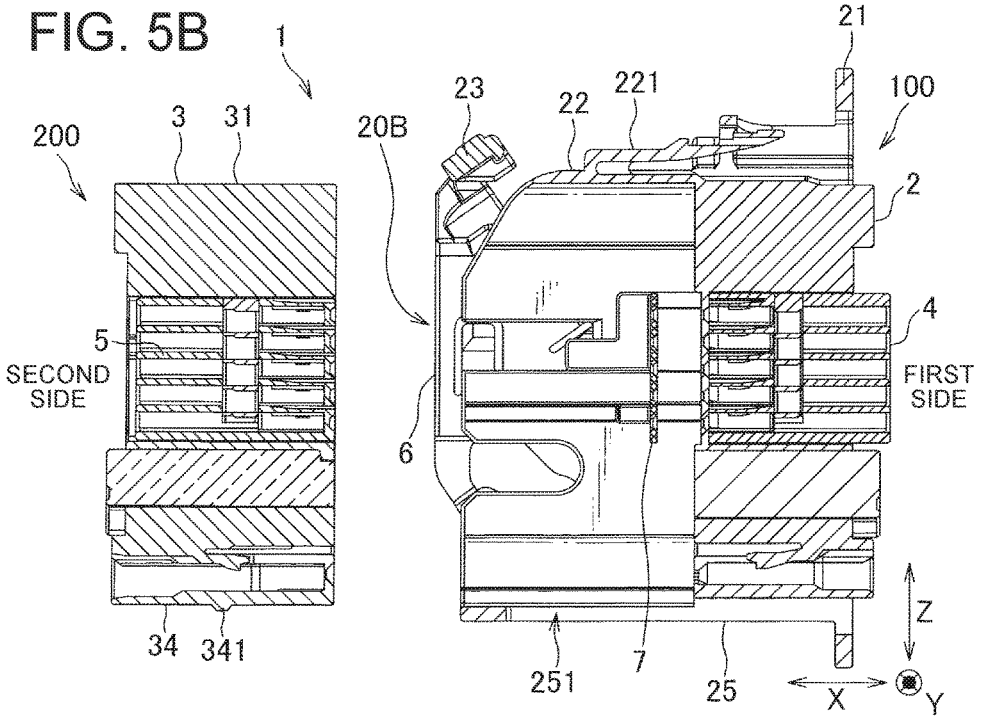
FIG. 5B a longitudinal cross-sectional view of the connector unit in the initial state.
Figure 5C:
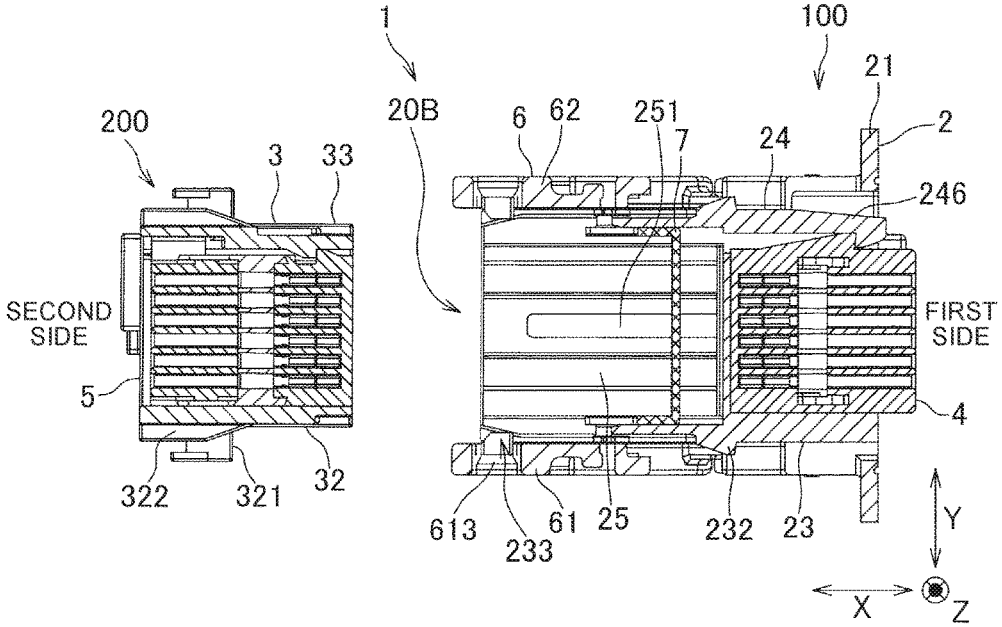
FIG. 5C is a transverse cross-sectional view of the connector unit in the initial state.
Figure 5D:
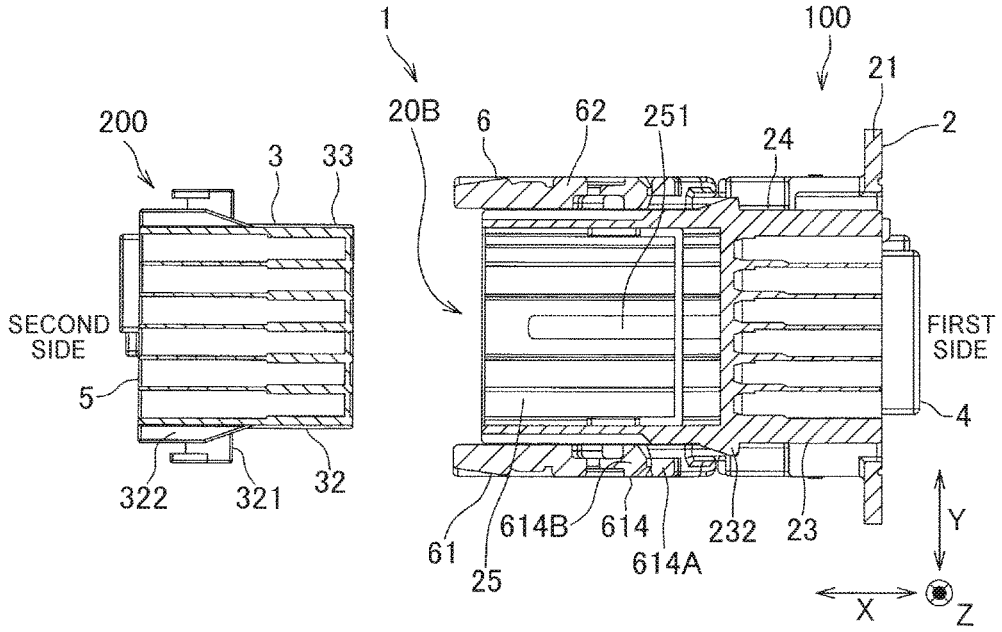
FIG. 5D is a transverse cross-sectional view of the connector unit in the initial state.
Figure 5E:
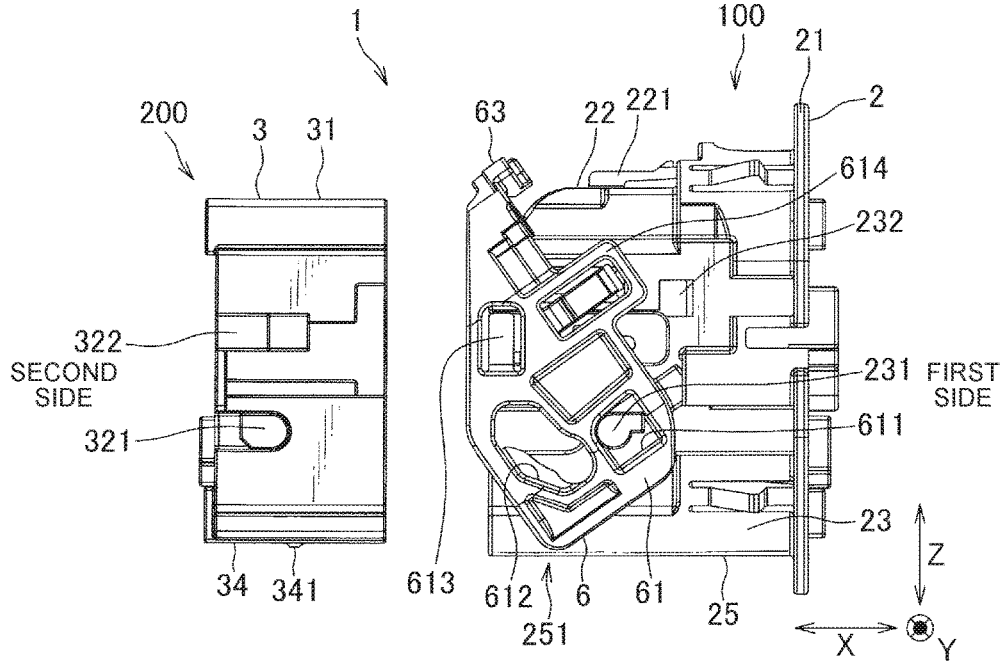
FIG. 5E is a side view of the connector unit in the initial state.
Figure 5F:
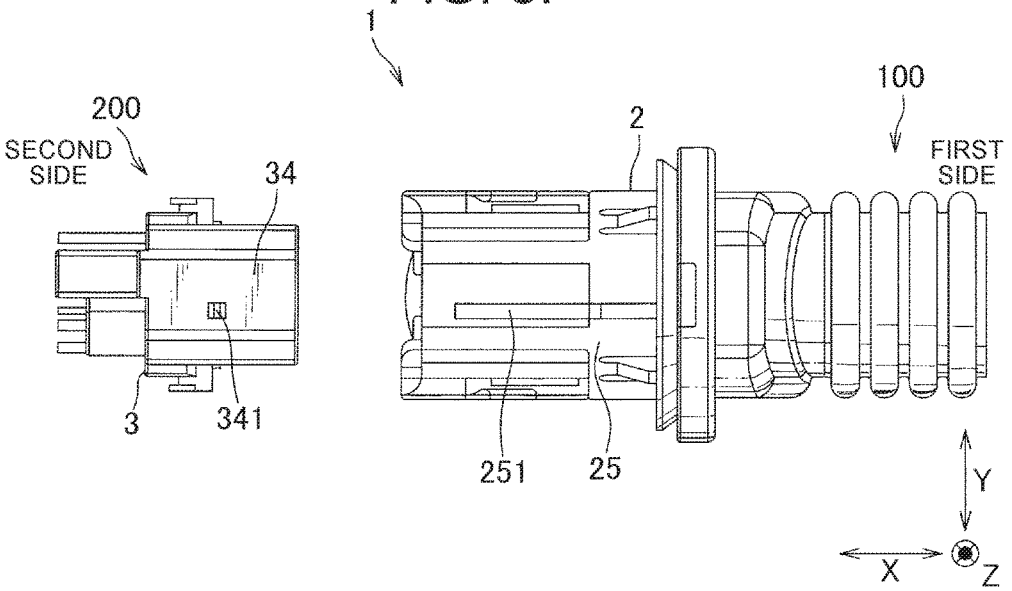
FIG. 5F is a bottom view of the connector unit in the initial state.
Figure 11A:
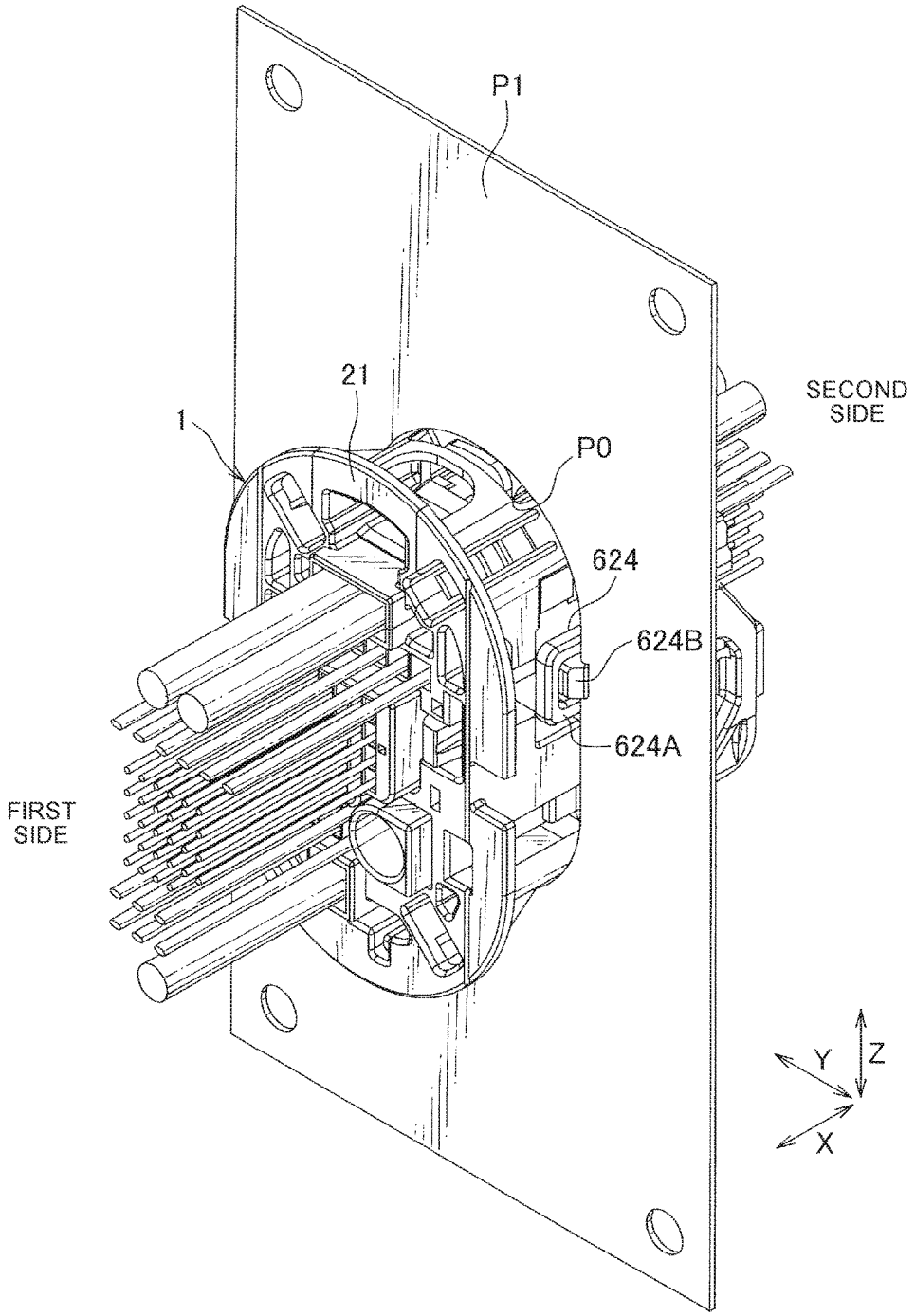
FIG. 11A is a perspective view illustrating an attachment of the connector unit in the provisional fit state to an object to be attached.
Figure 11B:
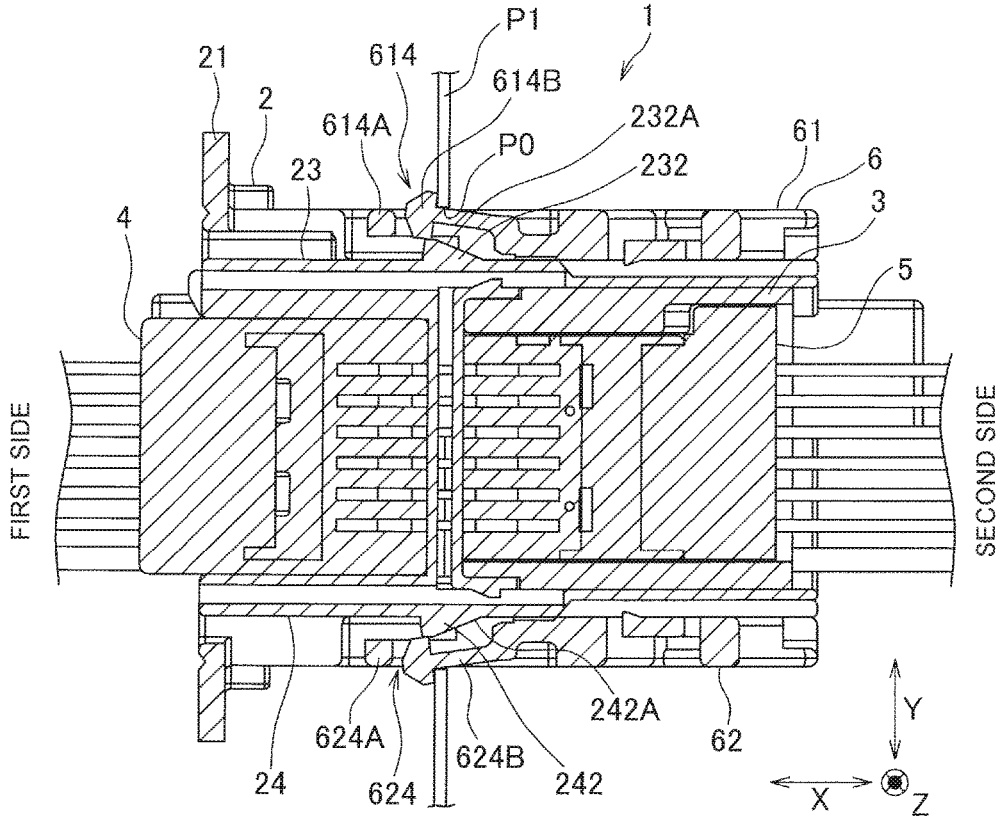
FIG. 11B is a cross-sectional view illustrating the attachment of the connector unit in the provisional fit state to the object to be attached.
Figure 12A:
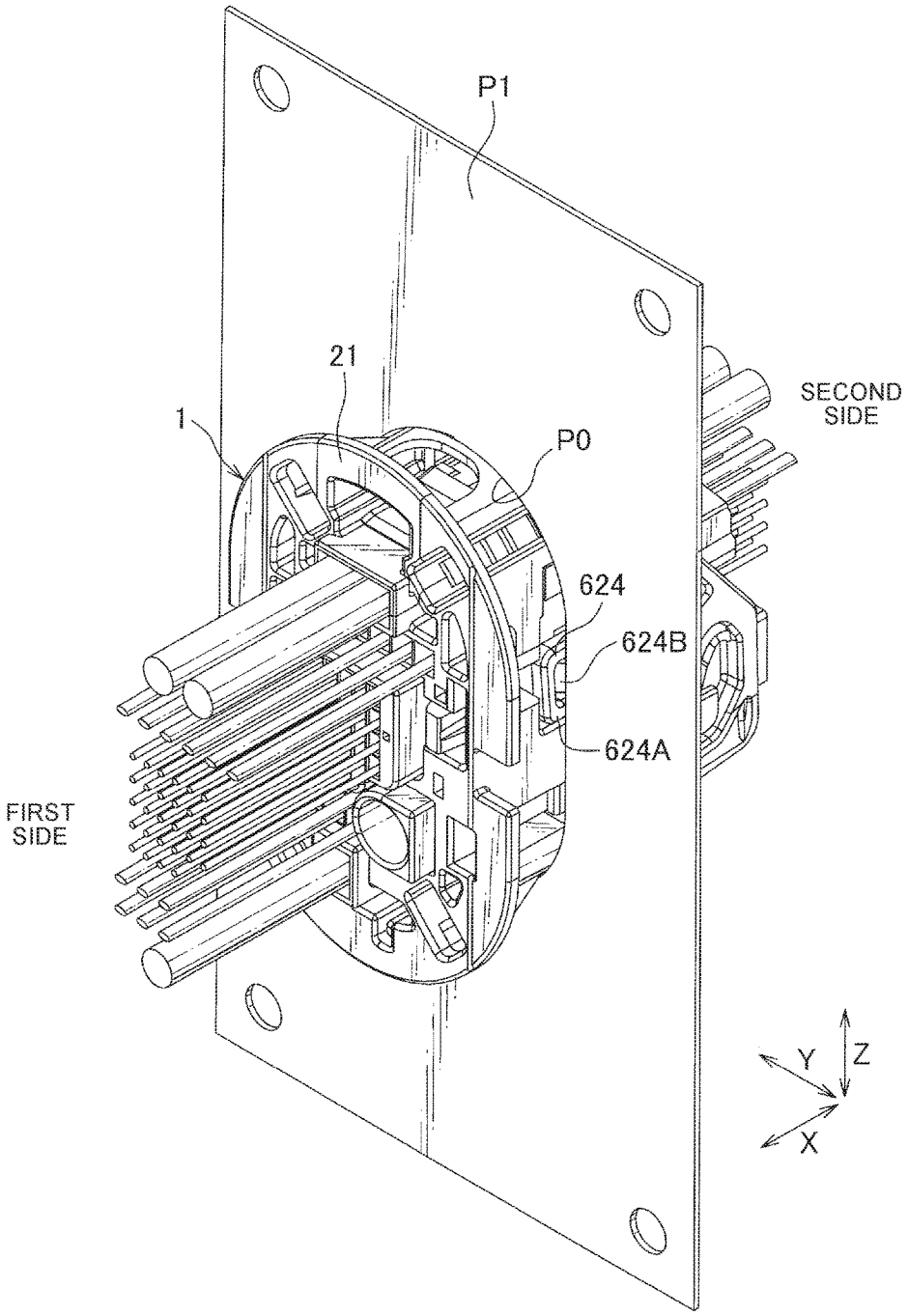
FIG. 12A is a perspective view illustrating a condition in which the attachment of the connector unit in the provisional fit state to the object has progressed.
Figure 12B:
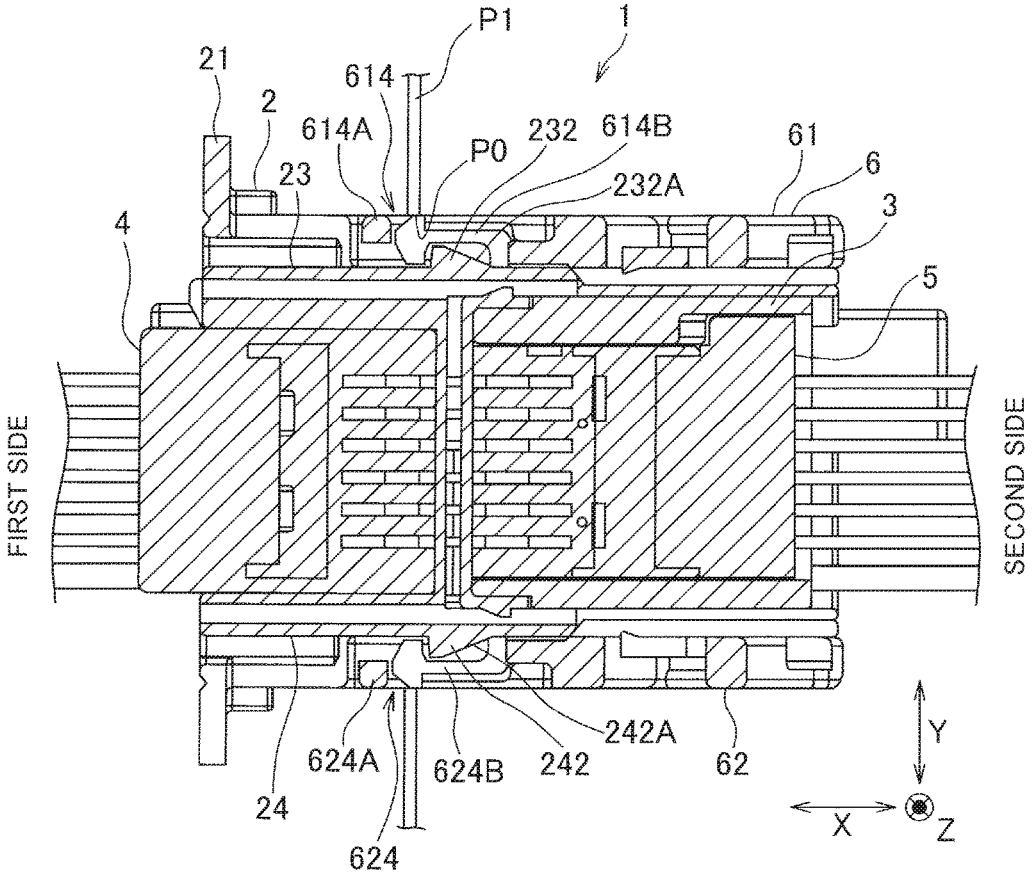
FIG. 12B is a cross-sectional view illustrating the condition in which the attachment of the connector unit in the provisional fit state to the object has progressed.

An embodiment of the first invention is explained below with reference to the drawings. FIG. 1 is an exploded perspective view showing a connector unit 1 according to an embodiment of the present invention, FIG. 2 is a cross-sectional view of the connector unit 1 with a male sub connector 4 housed in a male outer housing 2 of the connector unit 1, FIGS. 3A and 4A are a partial side view and a partial cross-sectional view respectively illustrating a state in which a housing amount of the male sub connector 4 within the male outer housing 2 is equal to a proper housing amount, FIGS. 3B and 4B are a partial side view and a partial cross-sectional view respectively illustrating a state in which the housing amount of the male sub connector 4 within the male outer housing 2 is less than the proper housing amount, FIGS. 5A, 5B, 5C, 5D, 5E and 5F are a perspective view, longitudinal cross-sectional view, transverse cross-sectional view, another transverse cross-sectional view, a side view and a bottom view respectively of the connector unit 1 in an initial state of assembling, FIGS. 6A, 6B, 6C, 6D, 6E and 6F are a perspective view, longitudinal cross-sectional view, transverse cross-sectional view, another transverse cross-sectional view, a side view and a bottom view respectively of the connector unit 1 in which a fitting process has progressed from the initial state, FIGS. 7A, 7B, 7C, 7D, 7E and 7F are a perspective view, longitudinal cross-sectional view, transverse cross-sectional view, another transverse cross-sectional view, a side view and a bottom view respectively of the connector unit 1 just after it has been in a provisional fit state, FIGS. 8A, 8B, 8C, 8D and 8E are a perspective view, longitudinal cross-sectional view, transverse cross-sectional view, another transverse cross-sectional view and a side view of the connector unit 1 in which a fitting process has progressed in the provisional fit state, FIGS. 9A, 9B, 9C, 9D and 9E are a perspective view, longitudinal cross-sectional view, transverse cross-sectional view, another transverse cross-sectional view and a side view of the connector unit 1 in which the fitting process has further progressed in the provisional fit state, FIGS. 10A, 10B, 10C, 10D and 10E are a perspective view, longitudinal cross-sectional view, transverse cross-sectional view, another transverse cross-sectional view and a side view of the connector unit 1 in a fully fitted state, FIGS. 11A and 11B are a perspective view and a cross-sectional view respectively illustrating the attachment of the connector unit 1 in the provisional fit state to an object P1 to be attached, and FIGS. 12A and 12B are a perspective view and a cross-sectional view illustrating a condition in which the attachment of the connector unit 1 in the provisional fit state to the object P1 has progressed.

A connector unit 1 according to this embodiment includes a male outer housing 2 as a first housing or an outer housing, a female outer housing 3 as a second housing, a male sub connector 4 as an inner member, a female sub connector 5 as an inner member, and a lever member 6. The male outer housing 2, the male sub connector 4 and the lever member 6 constitute a male connector 100, and the female outer housing 3 and the female sub connector 5 constitute a female connector 200. In this embodiment, an X direction refers to a fitting direction in which the male connector 100 and the female connector 200 fit each other, and a Y direction and a Z direction refer to two directions substantially perpendicular to the X direction, respectively. In addition, a side on which the male connector 100 is located in the X direction is referred to as a first side (one side), while a side on which the female connector 200 is located in the X direction is referred to as a second side (the other side).

The male outer housing 2 may be formed of resin member, for example, and formed into a quadrangular tube-like shape extending in the X direction. That is, an extending direction of the quadrangular tube-like shape (i.e., an axis direction of the tube) is in the X direction. The male outer housing 2 includes a first housing portion 20A arranged to house the male sub connector 4 inserted from the first side, and a second housing portion 20B arranged to house the female connector 200 inserted from the second side. Further, a flange portion 21 is formed at an edge (an end) of the male outer housing 2 on the first side in the X direction, the flange portion 21 having a diameter larger than other part.

Four side face portions 22-25 constitute the male outer housing 2, wherein an upper side face portion 22 along a XY plane is provided with a lever lock portion 221. The lever lock portion 221 is formed in to an arm-like shape having a proximal end on the second side in the X direction and extending toward the first side in the X direction. The lever lock portion 221 is entirely flexible and deformable so a lock projection formed at a tip end (i.e., distal end) of the lever lock portion 221 can move in the Z direction.

Of four side face portions 22-25 constituting the male outer housing 2, a transverse side face portion 23 along a ZX plane is provided with a lever rotation shaft 231, a detection projection 232, a first slit 233, a second slit 234 and a detection opening 235. Hereinafter the transverse side face portion 23 is explained, however a transverse side face portion 24 located on opposite side of the transverse side face portion 23 is also provided with a lever rotation shaft, a detection projection, a first slit and a second slit as those of the transverse side face portion 23. Further, in this embodiment the detection opening 235 is formed only at one transverse side face portion 23 on the first side, however the detection opening may also be formed at the other transverse side face portion 24. Further, the other transverse side face portion 24 is provided with a sub connector lock portion 246 (refer to FIG. 2) having a lock arm shape to lock (latch on) the male sub connector 4 housed in the first housing portion 20A.

The lever rotation shaft 231 projects from an outer face of the transverse side face portion 23 and is arranged to be inserted through a later-described axis portion 611 of the lever member 6 to pivotally support the lever member 6. The detection projection 232 projects from the outer face of the transverse side face portion 23 and includes a slanted face 232A slanted outward as it gets toward the first side from the second side along the X direction.

The first slit 233 extends from an edge of the transverse side face portion 23 on the second side in the X direction toward the first side, and is formed such that a later-described release projection 322 does not interfere with the transverse side face portion 23 when housing the female outer housing 3 in the second housing portion 20B. The second slit 234 extends from an edge of the transverse side face portion 23 on the second side in the X direction toward the first side, and is formed such that a later-described guide projection 321 does not interfere with the transverse side face portion 32 when housing the female outer housing 3 in the second housing portion 20B. The detection opening 235 is formed into a slit shape extending from an edge of the transverse side face portion 23 on the first side in the X direction toward the second side, and is positioned so as to align with the first slit 233 along the X direction. Accordingly, inside of the make outer housing 2 (i.e., the first housing portion 20A) can be seen through the detection opening 235 from outside of the male outer housing 2.

In this embodiment, the lever rotation shaft 231 is formed on the first side in the X direction of the second slit 234 so as to align with the second slit 234, the first slit 233 is formed at upward side of the lever rotation shaft 231 and the second slit 234, and the detection projection 232 is formed obliquely upward side (at the first side in the X direction) of the first slit 233. Position of the respective parts/elements may be arbitrarily chosen according to the position of the respective parts/elements of the female outer housing 3 or the lever member 6 and such.

Of four side face portions 22-25 constituting the male outer housing 2, a lower side face portion 25 along the XY plane is provided with a to-be-fitted portion 251. The to-be-fitted portion 251 is formed into a slit-like shape which extends from a location on the lower side face portion 25 distant, for a predetermined distance, from an edge of the lower side face portion 25 in the second side in the X direction and extends toward the first side in the X direction. The to-be-fitted portion may not be formed in to a shape penetrating through the lower side face portion 25 in the Z direction, instead it may be formed into a concaved shape depressed from an inner face (i.e., an upper face) of the lower side face portion 25.

The female outer housing 3 may be formed of resin member, for example, and formed into a quadrangular tube-like shape extending in the X direction. That is, an extending direction of the quadrangular tube-like shape (i.e., an axis direction of the tube) is in the X direction. The female outer housing 3 includes a third housing portion 30 arranged to house the female sub connector 5 inserted from the second side. The female outer housing 3 can be housed in the male outer housing 2 together with a moving plate 7.

Four side face portions 31-34 constitute the female outer housing 3, wherein a transverse side face portion 32 along the ZX plane is provided with the guide projection 321 and the release projection 322. Hereinafter the transverse side face portion 32 is explained, however a transverse side face portion 33 located on opposite side of the transverse side face portion 32 is also provided with a guide projection and a release projection as those of the transverse side face portion 32.

The guide projection 321 projects from an outer face of the transverse side face portion 32 and is formed into a hook-like shape opening in the second side in the X direction. The guide projection 321 has a width (i.e., size in the Z direction) which can pass through the second slit 234, and is also arranged to be inserted through and guided by a later-described guide groove 612 of the lever member 6. The release projection 322 projects from the outer face of the transverse side face portion 32 and extends in the X direction. The release projection 322 includes a slanted face which is located at an end thereof in the first side in the X direction and which is slanted outward as it gets toward the second side. The release projection 322 has a width (i.e., size in the Z direction) which can pass through the first slit 233, and is arranged to deform outward a later-described restriction arm 613 of the lever member 6. In this embodiment, the release projection 322 is disposed at upward side in the Z direction of the guide projection 321.

Of four side face portions 31-34 constituting the female outer housing 3, a lower side face portion 34 along the XY plane is provided with a fitting portion 341 (refer to FIG. 5). The fitting portion 341 is formed into a projecting shape projecting from an outer face of the lower side face portion 34. The fitting portion 341 is disposed at a location on the lower side face portion 34 distant, for a predetermined distance, from an edge of the lower side face portion 34 in the first side in the X direction. The fitting portion 341 is arranged to be inserted through and fitted with the slit-like to-be-fitted portion 251 when the female outer housing 3 is housed in the second housing portion 20B of the male outer housing 2.

The size in the Z direction of the second housing portion 20B of the male outer housing 2 (i.e., an interval between an inner face of the upper side face portion 22 and an inner face of the lower side face portion 25) is larger than the size in the Z direction of the female outer housing 3 not including the fitting portion 341 (i.e., a distance between an outer face of the upper side face portion 31 and an outer face of the lower side face portion 34), and smaller than the size in the Z direction of the female outer housing 3 including the fitting portion 341. Consequently, during the process of housing the female outer housing 3 in the second housing portion 20B, large fitting force (i.e., a force required to move the housings toward each other) is required by positioning the fitting portion 341 at the second housing portion 20B, and when the fitting portion 341 is fitted with the to-be-fitted portion 251, the required fitting force becomes small again.

The male sub connector 4 is formed of resin, for example, and includes a connector main body 41 and a spacer 42. The connector main body 41 includes a plurality of terminal housing chambers extending in the X direction, and the entire connector main body 41 is formed into a cuboid-like shape. The terminal chambers are arranged to house terminal fittings provided at respective tip ends of a plurality of electric wires provided to a male coaxial sub connector 8. The connector main body 41 includes an opening 411 formed at an upper face of the connector main body 41 and arranged for inserting the spacer 42. The connector main body 41 further includes a detection portion 412 at an outer face thereof laying along the ZX plane and facing to the transverse side face portion 23.

The detection portion 412 is formed into a convex shape and extends from an edge of a side face of the connector main body 41 located on the second side in the X direction toward the first side. The detection portion 412 is positioned such that it can be seen through the opening 235 while the male sub connector 4 is being housed in the male outer housing.

The spacer 42 is arranged to be inserted in the opening 411 of the connector main body 41, thereby holding the terminal fittings within the terminal chambers.

The female sub connector 5 is formed of resin, for example, and includes a connector main body and a spacer 52. The connector main body 51 includes a plurality of terminal housing chambers extending in the X direction, and the entire connector main body 51 is formed into a cuboid-like shape. The terminal chambers are arranged to house terminal fittings provided at respective tip ends of a plurality of electric wires provided to a female coaxial sub connector 9. The connector main body 51 includes an opening 511 formed at an upper face of the connector main body 51 and arranged for inserting the spacer 52. The spacer 52 is arranged to be inserted in the opening 511 of the connector main body 51, thereby holding the terminal fittings within the terminal chambers.

The lever member 6 is formed of resin, for example, and includes a pair of plate portions 61, 62 and a connecting portion 63. The pair of plate portions 61, 62 extends along the ZX plane (i.e., extends along the transverse side faces 23, 24 of the male outer housing 2), and is arranged to sandwich the male outer housing 2 in the Y direction. The plate portion 61 is provided with the shaft portion 611, the guide groove 612, the restriction arm 613 and the detection arm 614. Hereinafter the respective parts/elements of one plate portion 61 are explained, however the other plate portion 62 is also provided with a shaft, a guide groove, a restriction arm and a detection arm as those of the plate portion 61.

The axis portion 611 may be formed into a penetrating hole into which the lever rotation shaft 231 of the male outer housing 2 is inserted through. Accordingly, the lever member 6 is pivotally supported and rotatable with respect to the male outer housing 2 around the axis portion 611 and the lever rotation shaft 231. The shaft may not be formed into the penetrating hole, instead it may be formed into a concaved shape depressed from an inner face of the plate portion 61. Further, the shaft of the plate portion may be formed into a convex shape, while the lever rotation shaft of the male outer housing 2 may be formed into a penetrating hole or a concaved shape.

The guide groove 612 is formed into a slit penetrating through the plate portion 61, through which the guide projection 321 of the female outer housing 3 is inserted. The inner face of the plate portion 61 on the second side in the X direction is formed into a convex shape such that the guide projection 321 can easily enter into the guide groove 612. The guide groove 612 is a cam groove having a shape (or a track) which allows the guide projection 321 to move toward the first side in the X direction when the lever member 6 is rotated.

A tip end (i.e., distal end) of the restriction arm 613 is formed to protrude (convexed) inward. When the lever member 6 is attached to and pivotally supported on the male outer housing 2, the restriction arm 613 is positioned so as to extend toward the upper side with its proximal end positioned on the lower side in the Z direction, and the tip end of the restriction arm 613 is disposed in the first slit 233 of the male outer housing 2 such that it abuts on an upper edge or a lower edge of the first slit 233, thereby restricting the rotation of the lever member 6. When the restriction arm 613 is deformed outward, the tip end of the restriction arm 613 comes off from the first slit 233 and the restriction is released, allowing the lever member 6 to rotate.

The detection arm 614 is formed to project from an edge of the plate portion 61 and includes a frame portion 614A and an arm portion 614B provided in the frame portion 614A. The arm portion 614B is arranged to extend along the X direction from the second side toward the first side before and while the connecting portion 63 of the lever member 6 is latched onto (engaged with) the lever lock portion 221 of the male outer housing 2.

A tip end (i.e., distal end) of the arm portion 614B is formed into a convexed shape at both sides in the Y direction, such that when the connecting portion 63 is latched onto (engaged with) the lever lock portion 221, the inner convexed portion at the tip end of the arm portion 614B is latched onto (engaged with) the detection projection 232. The frame portion 614A is arranged not to interfere with the detection projection 232.

The connecting portion 63 is arranged to extend along the Y direction, arranged to face an outer side of the upper side face portion 22 of the male outer housing 2, and is arranged to latch on the lever lock portion 221.

The following will explain a method for assembling the male connector 100 and the female connector 200, and a method for assembling the connector unit 1 by fitting the male connector 100 and the female connector 200 together. Firstly, the lever member 6 is attached to the male outer housing 2, such that the axis portion 611 is pivotally supported to the lever rotation shaft 231 and the restriction arm 613 is positioned at the first slit 233. Then, the male sub connector 4 in which the terminal fittings are housed is moved closer to the male outer housing 2 from the first side in the X direction and is housed in the first housing portion 20A, thereby assembling the male connector 100. Alternatively, the lever member 6 may be attached after the male sub connector 4 is housed in the male outer housing 2.

FIG. 2 is a cross-sectional view of the male connector 100 taken along the XY plane passing through the detection opening 235 and the detection portion 412. In FIG. 2, a housing amount of the male sub connector 4 within the male outer housing 2 is equal to a proper housing amount, and the male sub connector 4 is locked by the sub connector lock portion 246. The term "housing amount" herein is used to indicate how much the male sub connector 4 is housed in the male outer housing 2. At this stage, the detection portion 412 is completely hidden by the transverse side face portion 23 of the male outer housing 2 so the detection portion 412 cannot be seen through the detection opening 235, as shown in FIGS. 3A and 4A.

Meanwhile, if the housing amount of the male sub connector 4 within the male outer housing 2 is less than the proper housing amount and the male sub connector 4 is not locked by the sub connector lock portion 246, the detection portion 412 can be seen through the detection opening 235, as shown in FIGS. 3B and 4B. That is, when the detection portion 412 cannot be seen through the detection opening 235, then it can be determined that the male sub connector 4 is properly housed in the first housing portion 20A and is locked by the sub connector lock portion 246.

When determining whether the male sub connector 4 is properly housed or not by using the detection portion 412 in a manner described above, a detection plate P as a jig may be inserted in the detection opening 235 along an edge of the detection opening 235 on the second side in the X direction, and the depth for which the detection plate P can be inserted at most (hereinafter called "insertable depth"), can be used to make the determination. That is, if the housing amount is less than the proper housing amount, the detection plate P abuts on the detection portion 412 and cannot be inserted further, as shown in FIG. 4B. Meanwhile, if the housing amount is equal to the proper housing amount, the detection plate P does not abut on the detection portion 412 and can be inserted further, as shown in FIG. 4A. Thus, the insertable depth differs depending on whether or not the housing amount is equal to the proper housing amount. By the way, there is a case where a rod-like fitting is inserted into the terminal chamber to determine whether the sub connectors 4, 6 are properly assembled or not. In this case, the detection plate P may be provided to determine the housing amount of the male sub connector 4.

The female connector 200 is assembled by inserting the female sub connector 5 having the terminal fittings housed therein into the third housing portion 30 of the female outer housing 3 from the second side in the X direction.

The following will explain a procedure of fitting the male connector 100 with the female connector 200 assembled as described above, and action of the respective parts/elements with reference to FIGS. 5A through 10E. FIGS. 5A through 5E show the state at substantially the same timing, FIGS. 6A through 6E show the state at substantially the same timing, FIGS. 7A through 7E show the state at substantially the same timing, FIGS. 8A through 8E show the state at substantially the same timing, FIGS. 9A through 9E show the state at substantially the same timing, and FIGS. 10A through 10E show the state at substantially the same timing. Further, FIGS. 5C, 6C, 7C, 8C, 9C and 10C show the cross-sectional view taken along a line passing through the first slit 233, and FIGS. 5D, 6D, 7D, 8D, 9D and 10D show the cross-sectional view taken along a line passing through the tip end of the detection arm 614.

FIGS. 5A through 5E illustrate the initial state of the connector unit 1. In the initial state, the restriction arm 613 of the lever member 6 is positioned in the first slit 233, restricting the rotation of the lever member 6. Further, the position in the Z direction of the end of the guide groove 612 located on the second side in the X direction is substantially matched with the second slit 234, such that the guide projection 321 can enter in the guide groove 612.

Figure 6A:
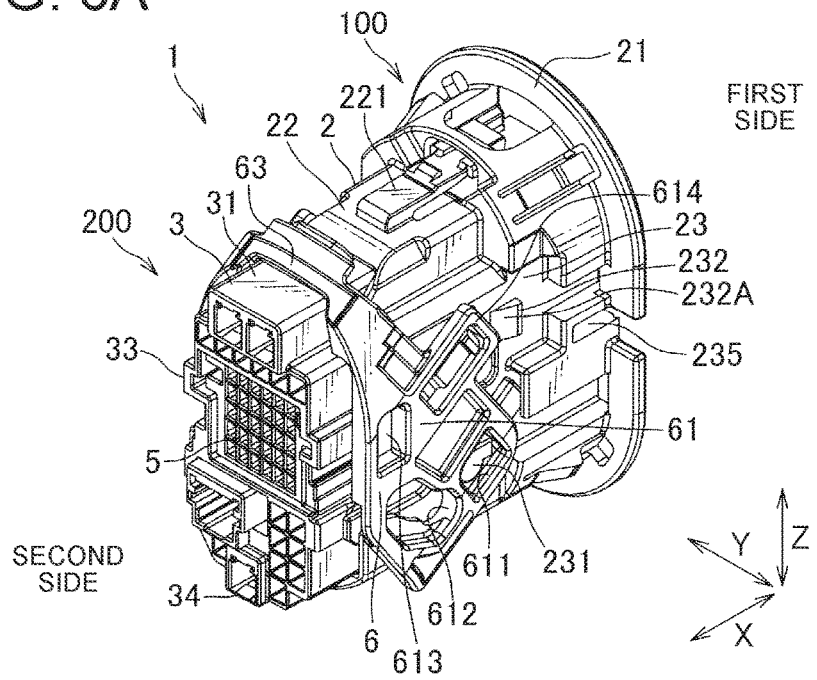
FIG. 6A is a perspective view of the connector unit in which a fitting progress has progressed from the initial state.
Figure 6B:
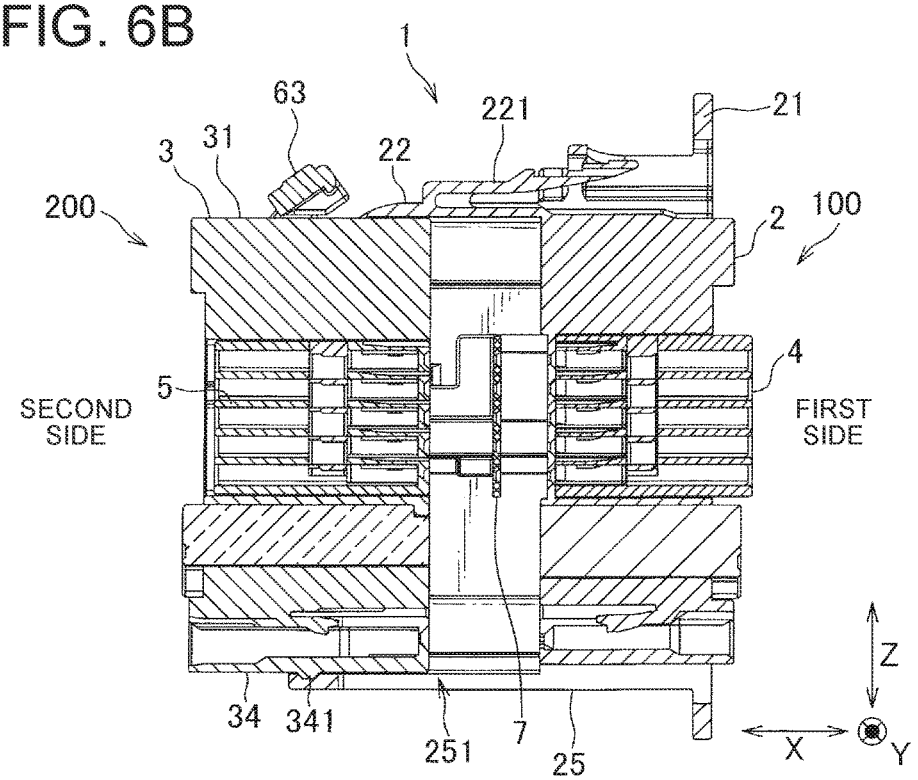
FIG. 6B is a longitudinal cross-sectional view of the connector unit in which the fitting process has progressed from the initial state.
Figure 6C:
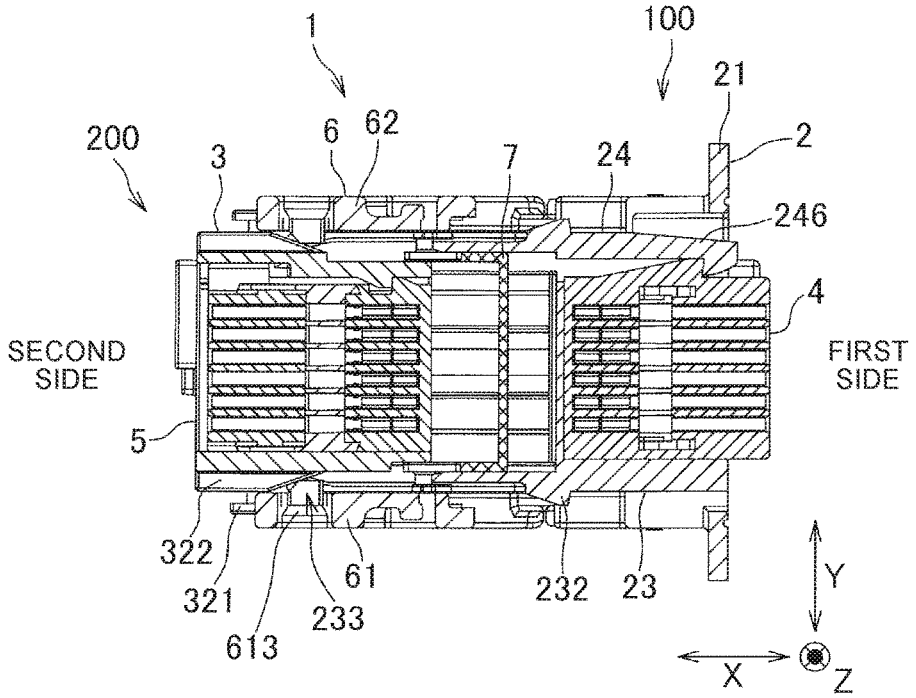
FIG. 6C is a transverse cross-sectional view of the connector unit in which the fitting process has progressed from the initial state.
Figure 6D:
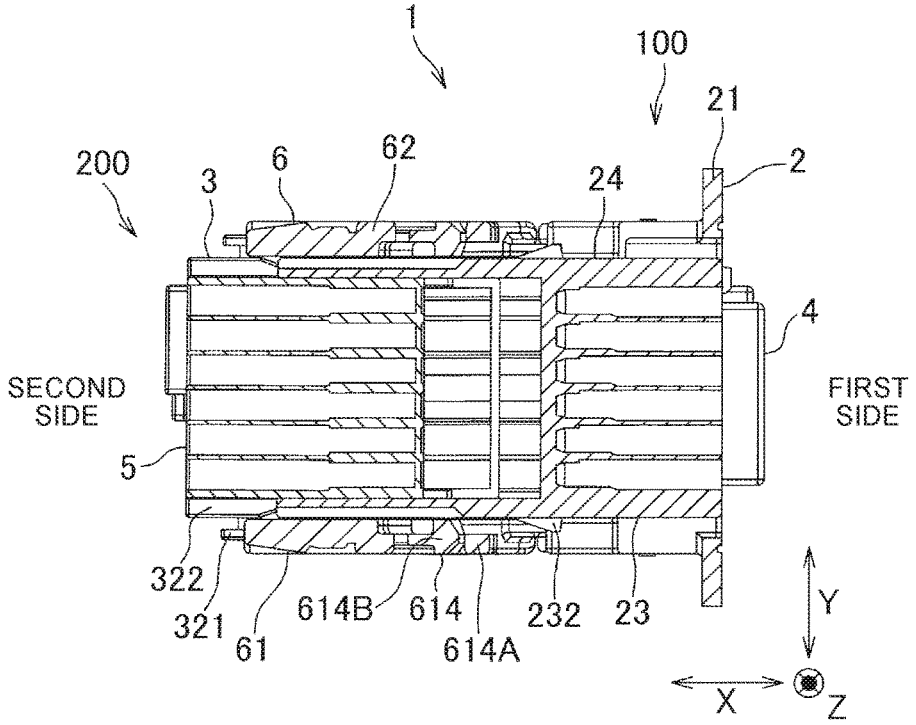
FIG. 6D is a transverse cross-sectional view of the connector unit in which the fitting process has progressed from the initial state.
Figure 6E:
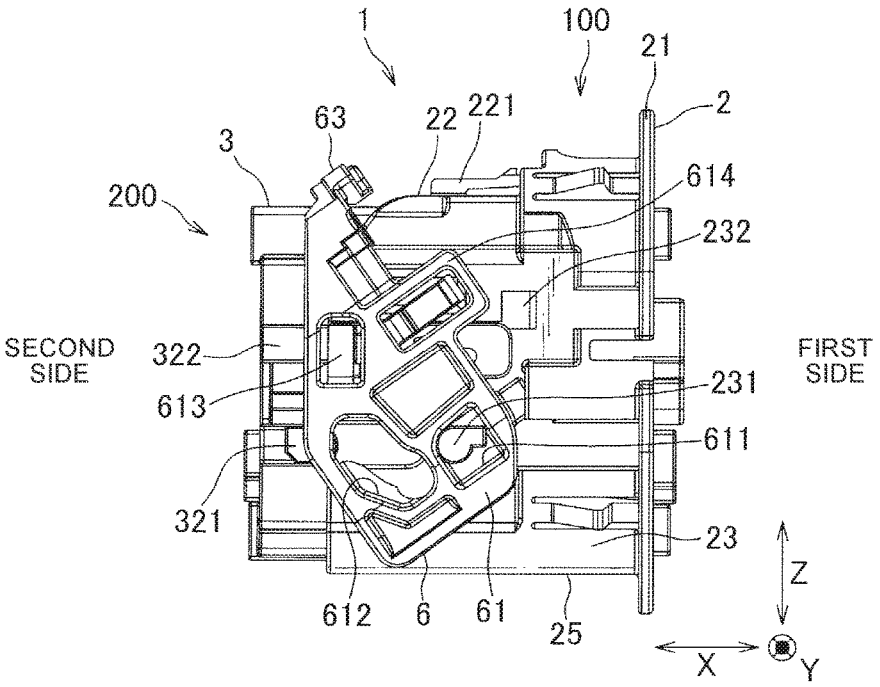
FIG. 6E is a side view of the connector unit in which the fitting process has progressed from the initial state.
Figure 6F:
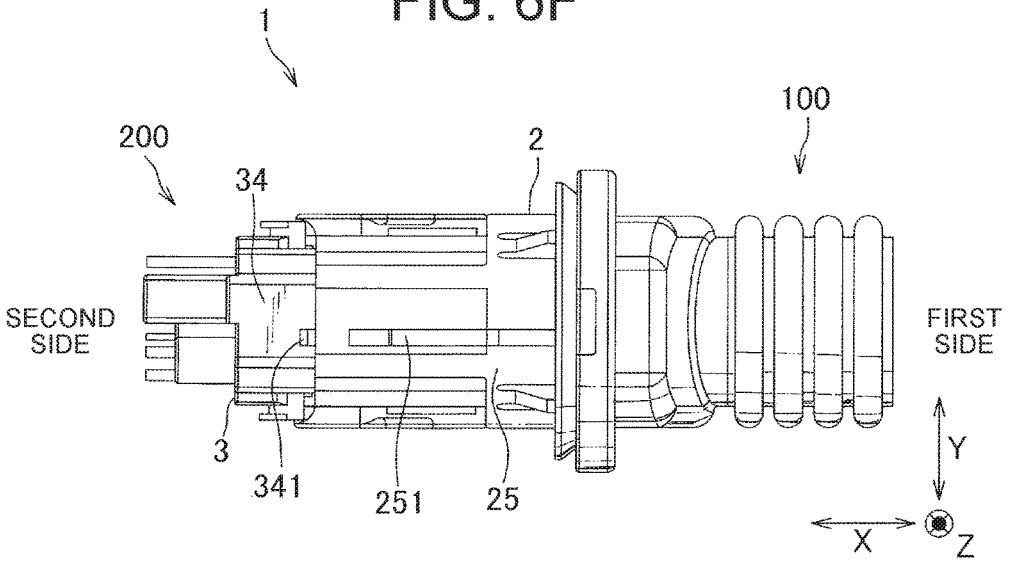
FIG. 6F is a bottom view of the connector unit in which the fitting process has progressed from the initial state.

From this initial state, the female connector 200 and the moving plate 7 are moved closer to the male outer housing 2 from the second side in the X direction and are housed in the second housing portion 20B by an operator. When an insertion amount of the female connector 200 into the male outer housing 2 becomes equal to the first insertion amount, the fitting portion 341 abuts on the edge of the lower side face portion 25 where it starts to be housed in the second housing portion 20B, as shown in FIG. 6F. Consequently, at the point when the insertion amount becomes larger than the first insertion amount, the required fitting force will increase rapidly. Further, as shown in FIG. 6C, before and after the insertion amount becomes equal to the first insertion amount, the release projection 322 abuts on the restriction arm 613, and the restriction arm 613 starts to be deformed outward. FIG. 6F shows the state slightly before the state shown in FIGS. 6A through 6E.

Figure 7A:
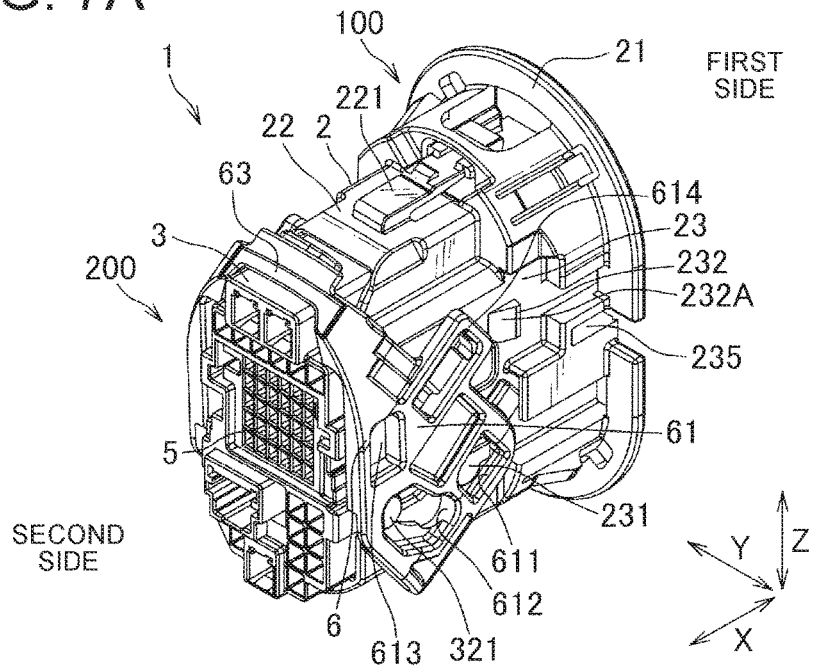
FIG. 7A is a perspective view of the connector unit just after it has been in a provisional fit state.
Figure 7B:
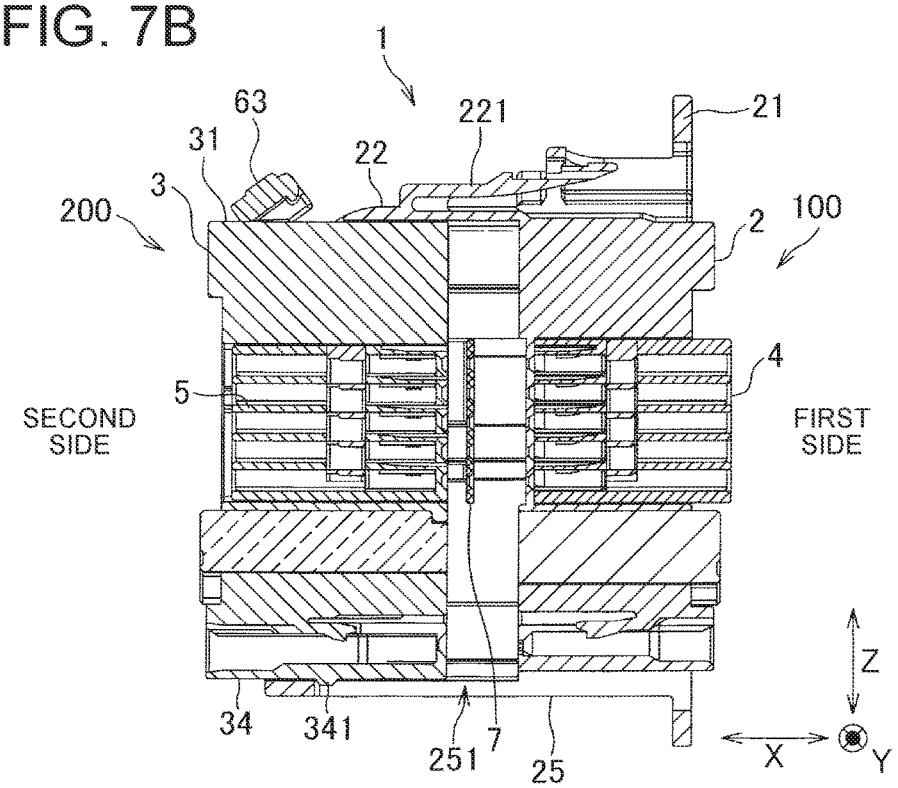
FIG. 7B is a longitudinal cross-sectional view of the connector unit just after it has been in the provisional fit state.
Figure 7C:
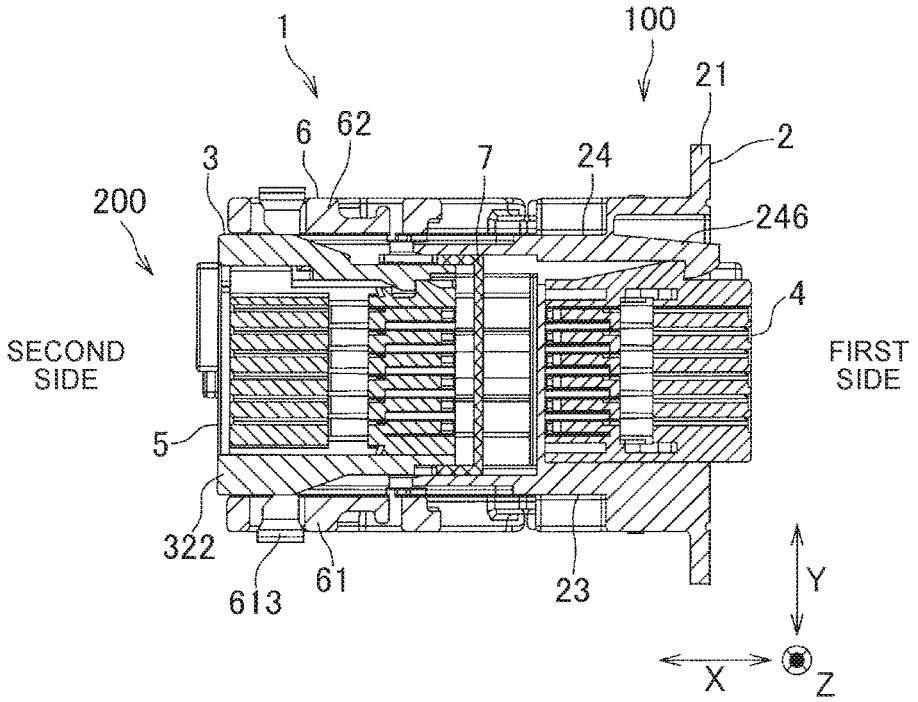
FIG. 7C is a transverse cross-sectional view of the connector unit just after it has been in the provisional fit state.
Figure 7D:
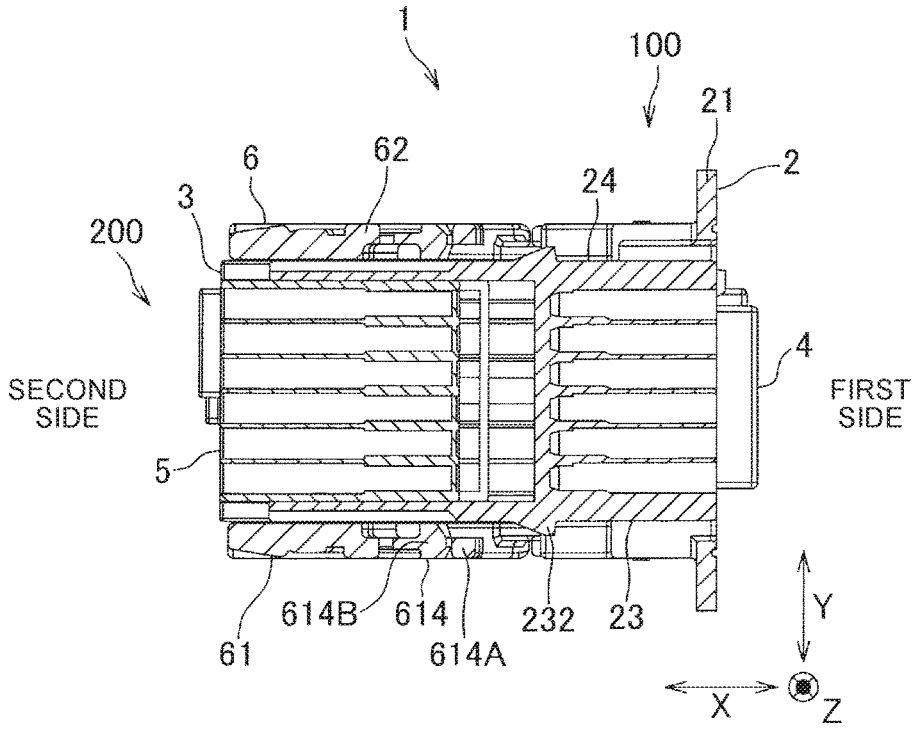
FIG. 7D is a transverse cross-sectional view of the connector unit just after it has been in the provisional fit state.
Figure 7E:
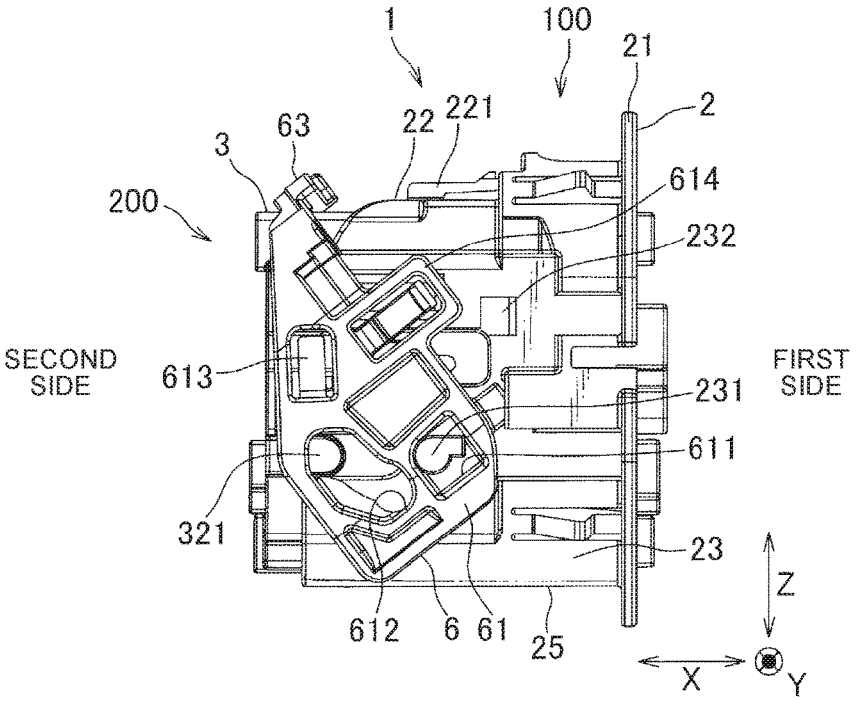
FIG. 7E is a side view of the connector unit just after it has been in the provisional fit state.
Figure 7F:
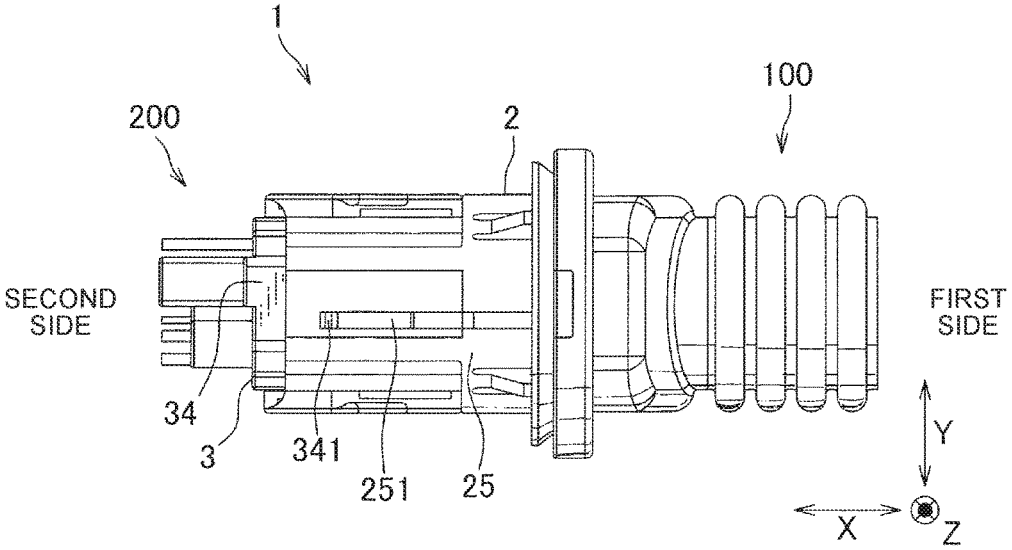
FIG. 7F is a bottom view of the connector unit just after it has been in the provisional fit state.

When the female connector 200 is further inserted and when the insertion amount becomes equal to the second insertion amount, the guide projection 321 can be inserted through and guided by the guide groove 612, as shown in FIG. 7E. At substantially the same time, the restriction arm 613 is deformed outward by the release projection 322 and comes off from the first slit 233, thereby releasing the restriction, as shown in FIG. 7C. Further, at substantially the same time, the fitting portion 341 is fitted with the to-be-fitted portion 25, and the required fitting force becomes small, as shown in FIGS. 7B and 7F. That is, the insertion of the guide projection 321 through the guide groove 612, the restriction release of the restriction arm 613 by the release projection 322, and the fitting of the fitting portion 341 with the to-be-fitting portion 251 take place at substantially the same time. Accordingly, the connector unit 1 is now in the provisional fit state. Herein, the term provisional fit state is referred to as a state in which the fitting portion 341 is fitted with the to-be-fitted portion 251, but before the connecting portion 63 is latched on the male outer housing 2.

Figure 8A:
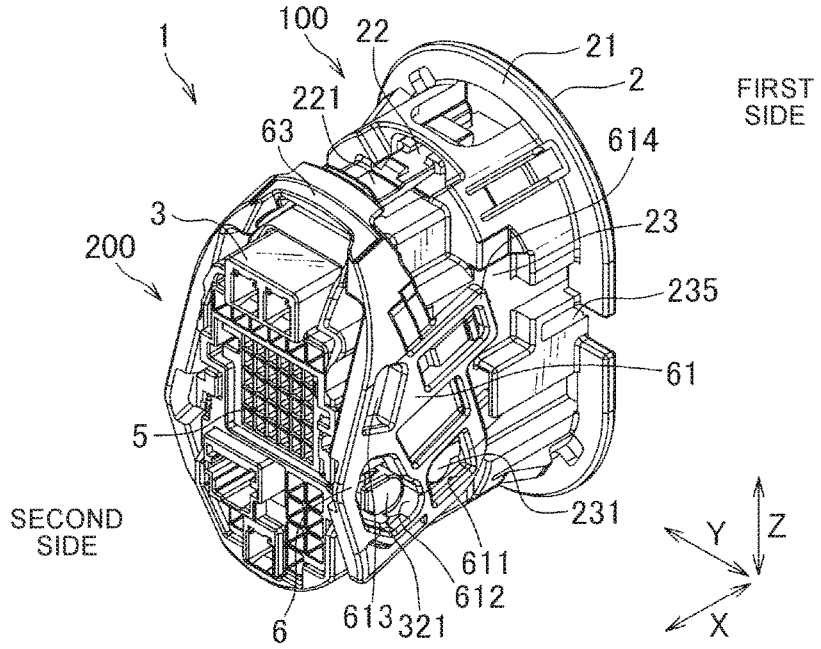
FIG. 8A is a perspective view of the connector unit in which a fitting process has progressed in the provisional fit state.
Figure 8B:
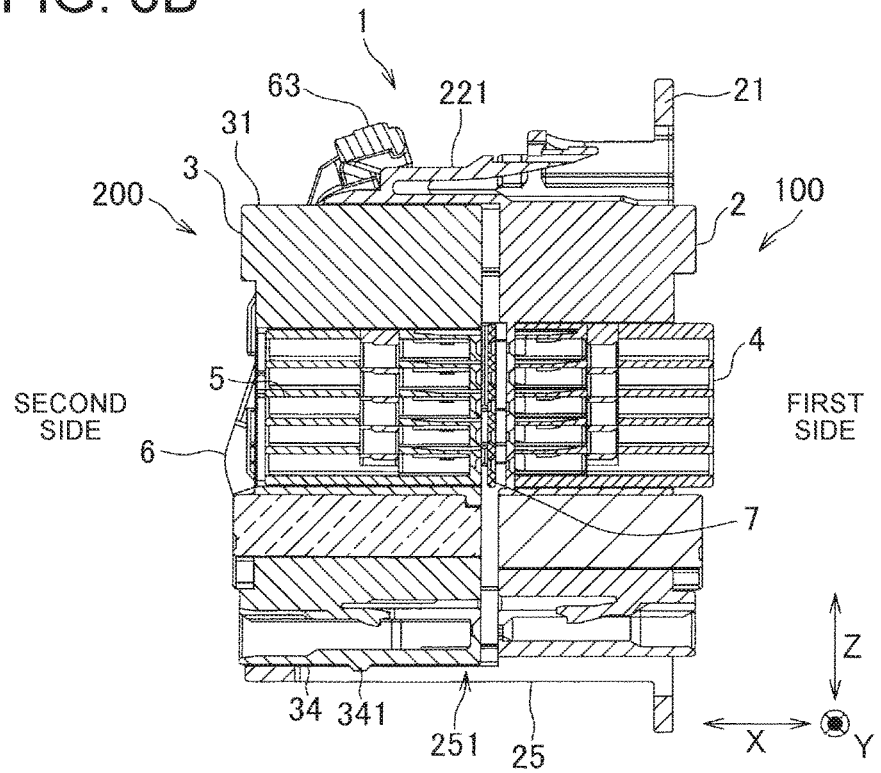
FIG. 8B is a longitudinal cross-sectional view of the connector unit in which the fitting process has progressed in the provisional fit state.
Figure 8C:
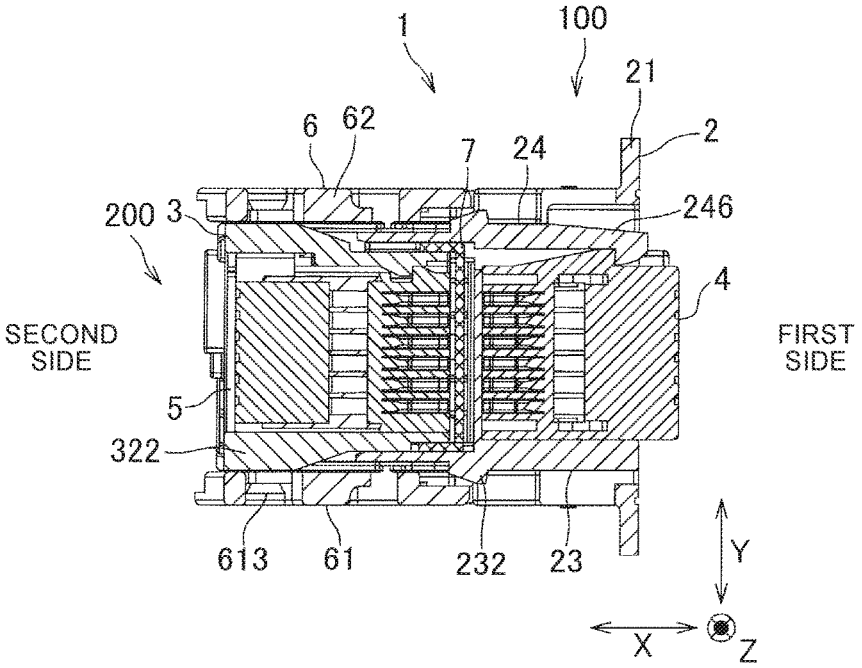
FIG. 8C is a transverse cross-sectional view of the connector unit in which the fitting process has progressed in the provisional fit state.
Figure 8D:
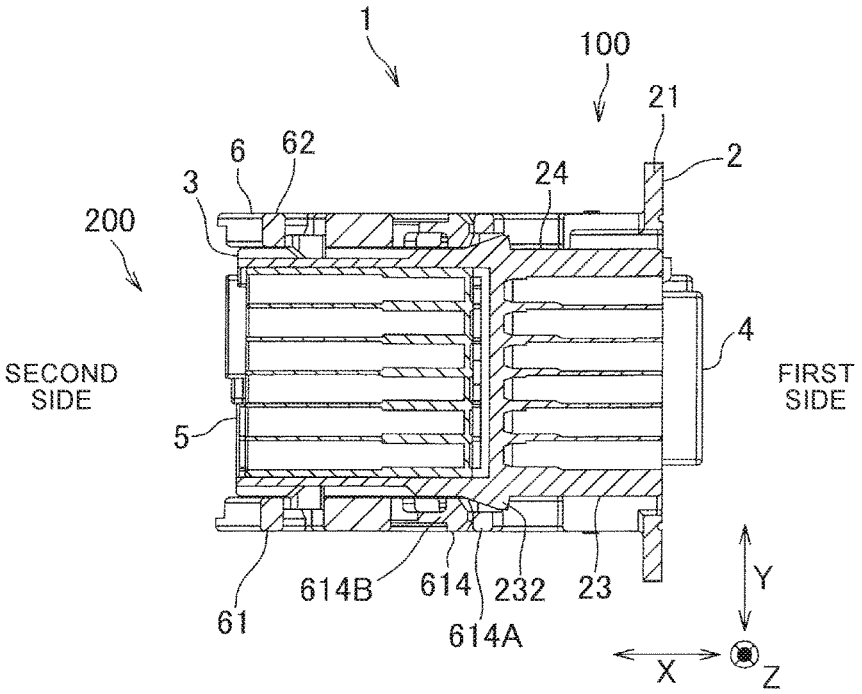
FIG. 8D is a transverse cross-sectional view of the connector unit in which the fitting process has progressed in the provisional fit state.
Figure 8E:
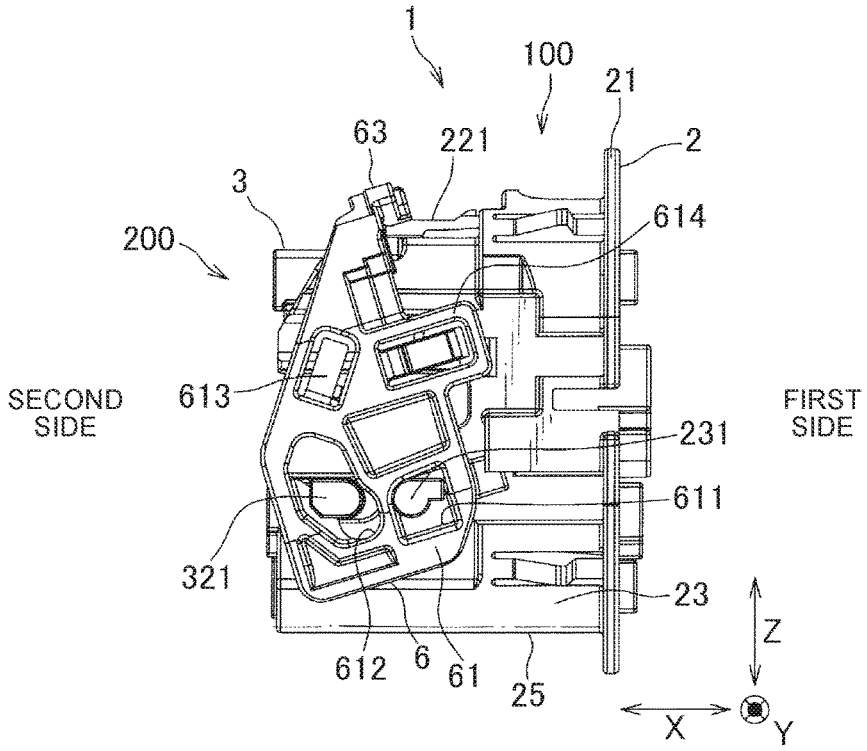
FIG. 8E is a side view of the connector unit in which the fitting process has progressed in the provisional fit state.

Next, the lever member 6 is rotated by the operator in the direction that the connecting portion 63 is moved closer to the lever lock portion 221. Accordingly, the guide projection 321 is guided by the guide groove 612, and the female connector 200 is gradually housed in the second housing portion 20B of the make outer housing 2, as shown in FIGS. 8A through 8E. At this point, the detection arm 614 is moved closer to the detection projection 232, as shown in FIG. 8E.

Figure 9A:
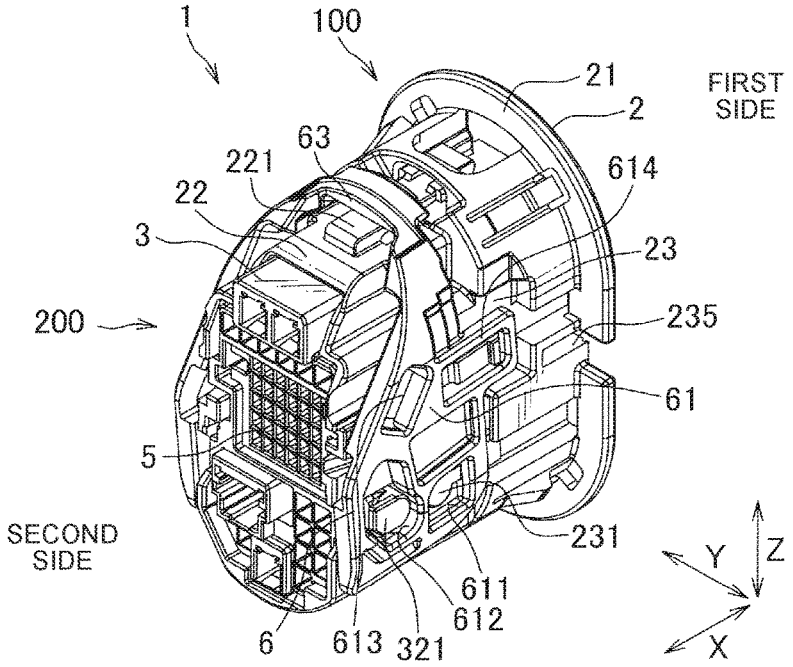
FIG. 9A is a perspective view of the connector unit in which the fitting process has further progressed in the provisional fit state.
Figure 9B:
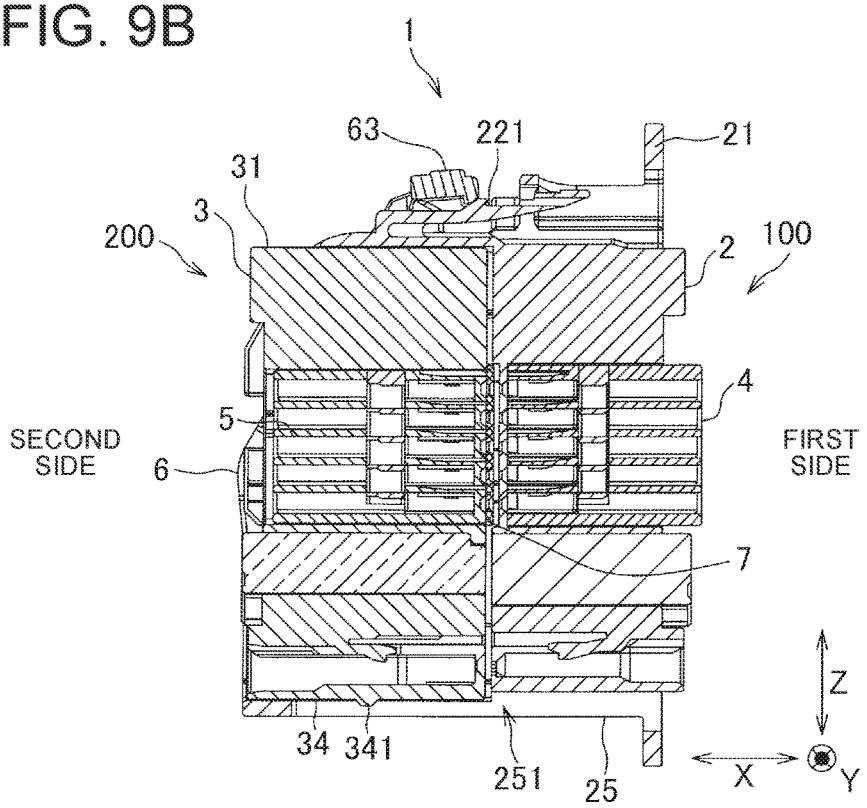
FIG. 9B is a longitudinal cross-sectional view of the connector unit in which the fitting process has further progressed in the provisional fit state.
Figure 9C:
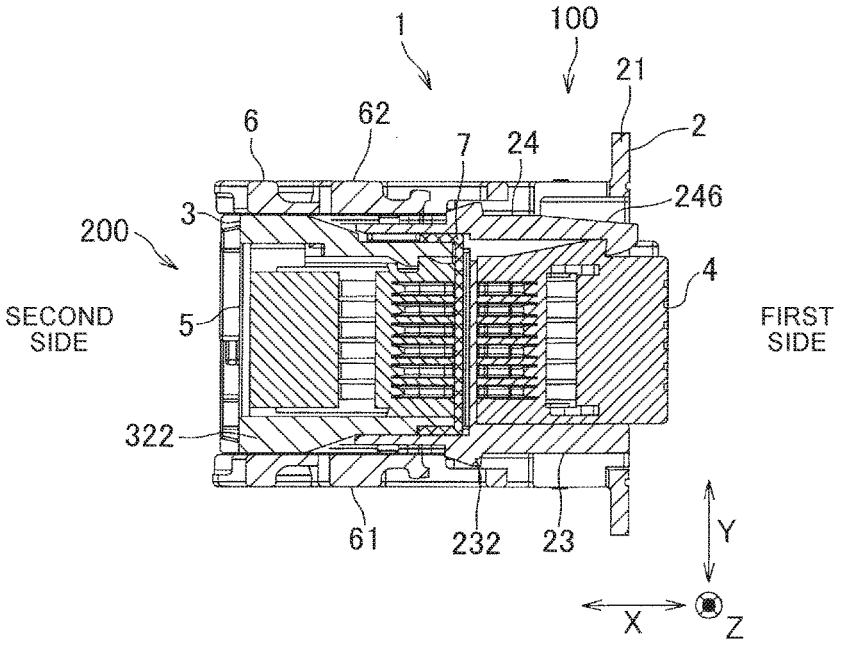
FIG. 9C is a transverse cross-sectional view of the connector unit in which the fitting process has further progressed in the provisional fit state.
Figure 9D:
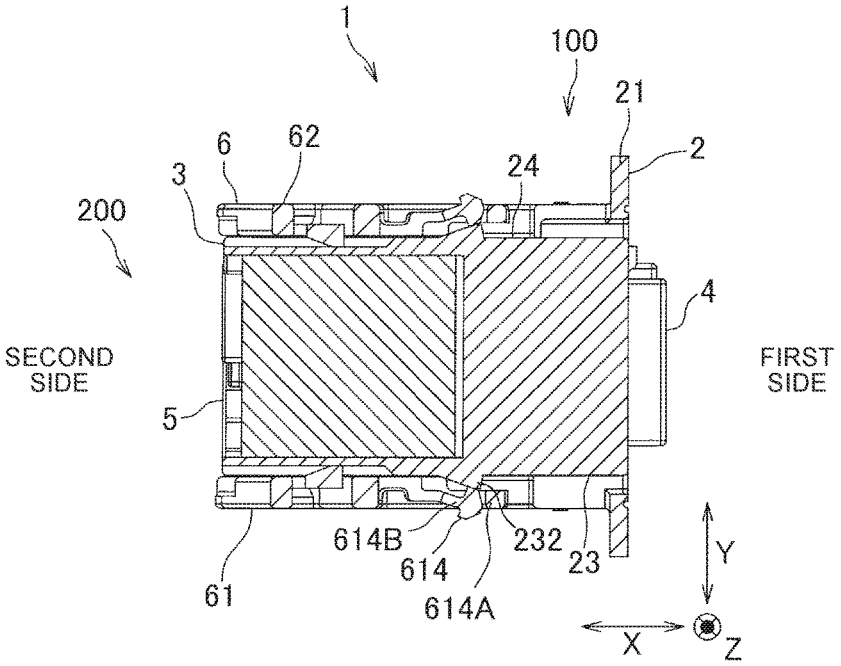
FIG. 9D is a transverse cross-sectional view of the connector unit in which the fitting process has further progressed in the provisional fit state.
Figure 9E:
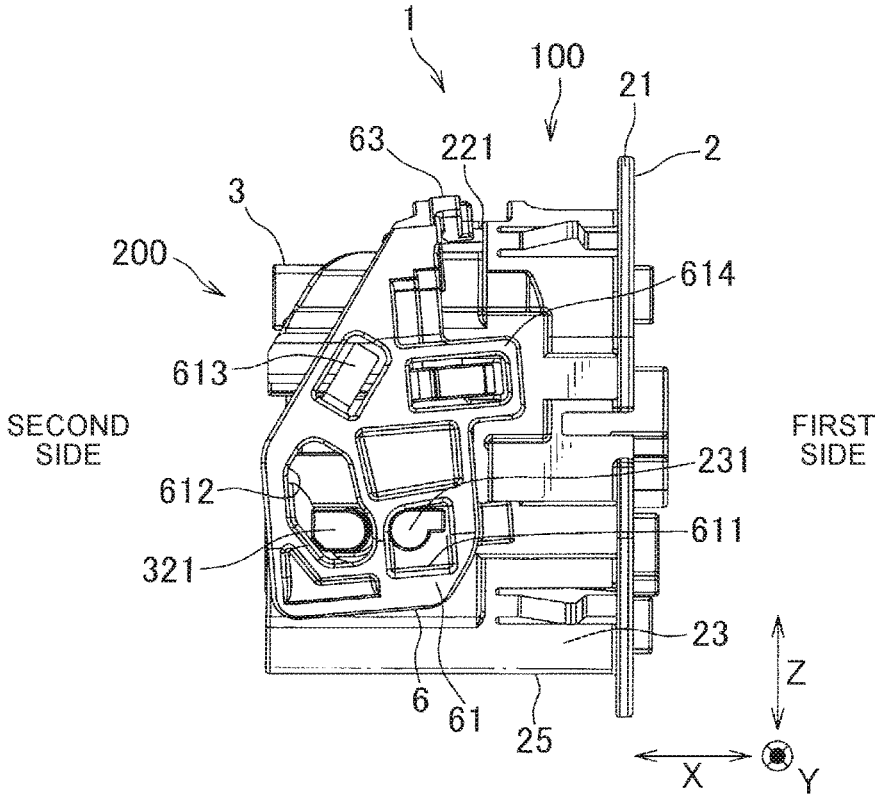
FIG. 9E is a side view of the connector unit in which the fitting process has further progressed in the provisional fit state.

When the lever member 6 is further rotated, the arm portion 614B of the detection arm 614 abuts on the detection projection 232 and goes onto the slanted face 232A, thereby the arm portion 614B is deformed outward as shown in FIG. 9D. In addition, the restriction arm 613 that has been released by the release projection 322 may not abut on the release projection 322 along with the rotation of the lever member 6, and the restriction arm 613 should be arranged at the suitable position which does not restrict the rotation.

Figure 10A:
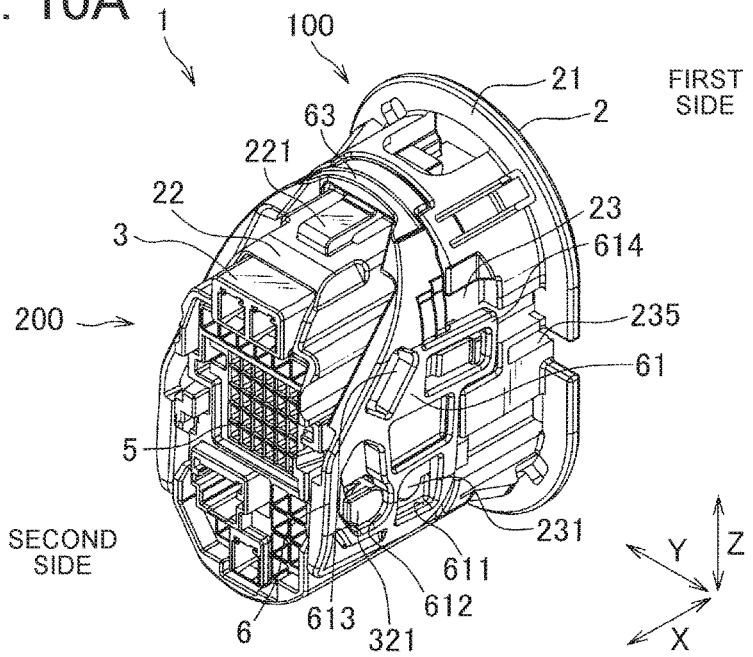
FIG. 10A is a perspective view of the connector unit in a fully fitted state.
Figure 10B:
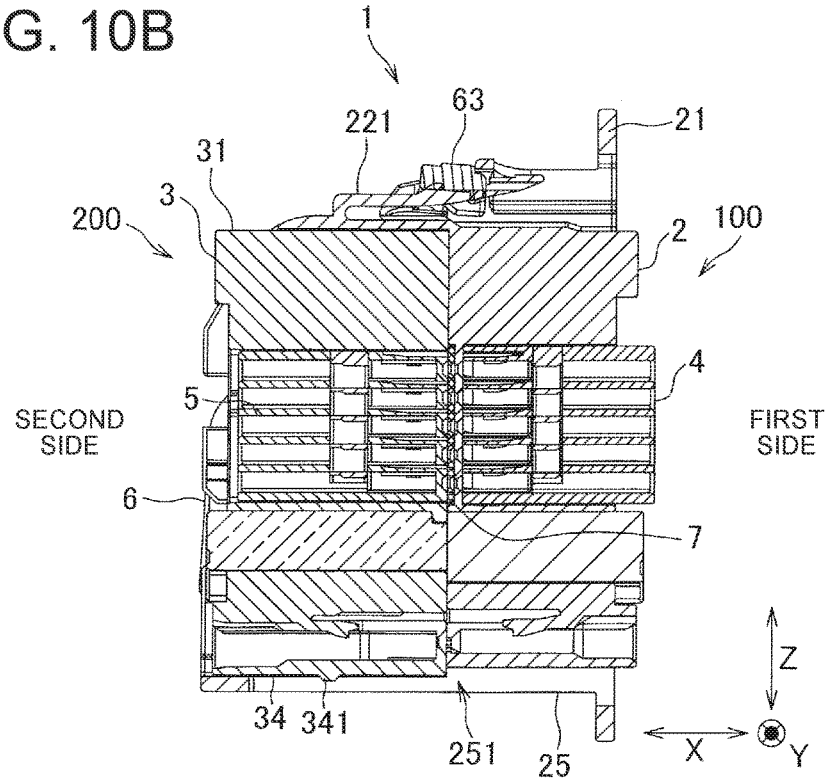
FIG. 10B is a longitudinal cross-sectional view of the connector unit in the fully fitted state.
Figure 10C:
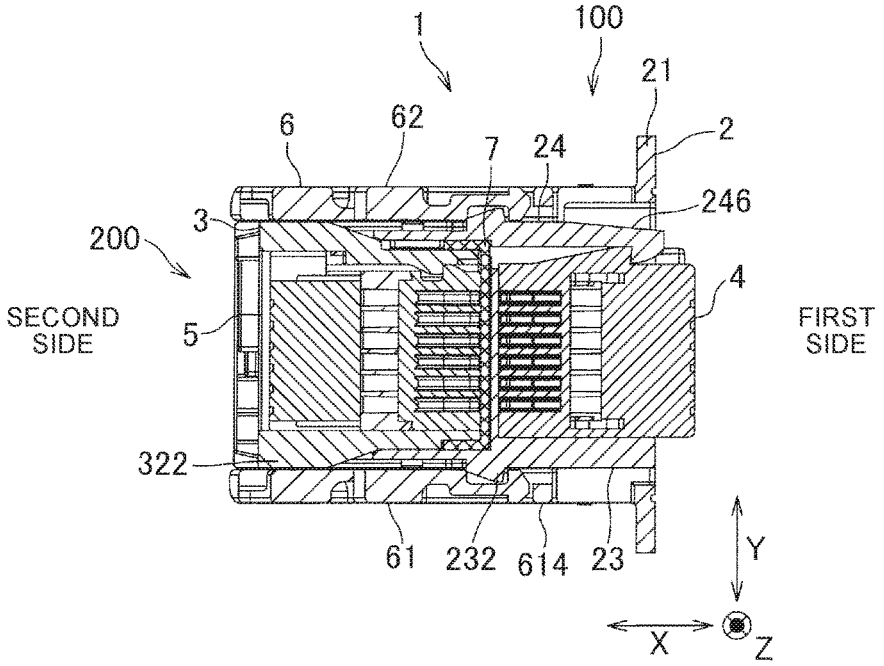
FIG. 10C is a transverse cross-sectional view of the connector unit in the fully fitted state.
Figure 10D:
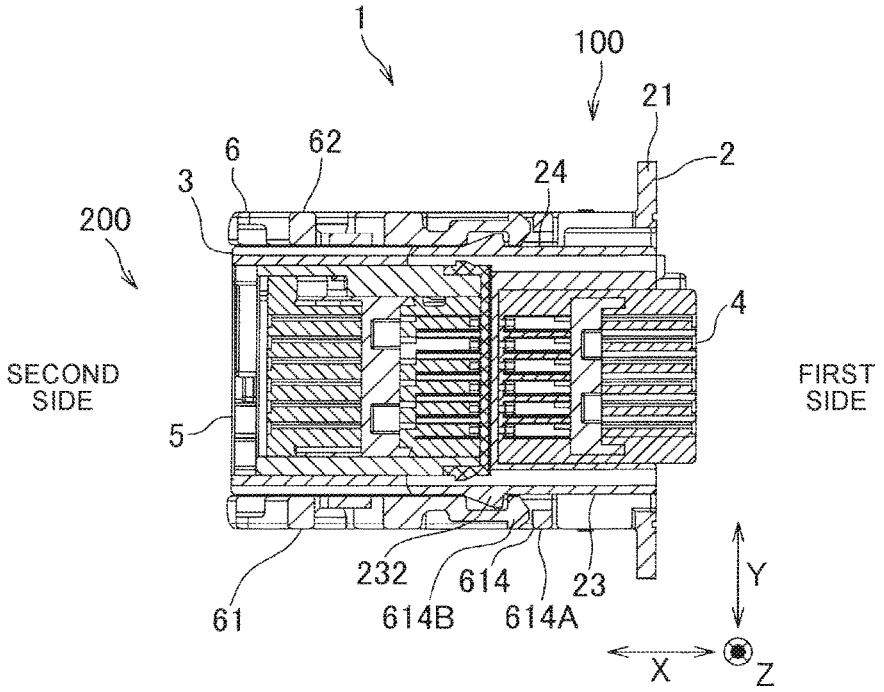
FIG. 10D is a transverse cross-sectional view of the connector unit in the fully fitted state.
Figure 10E:
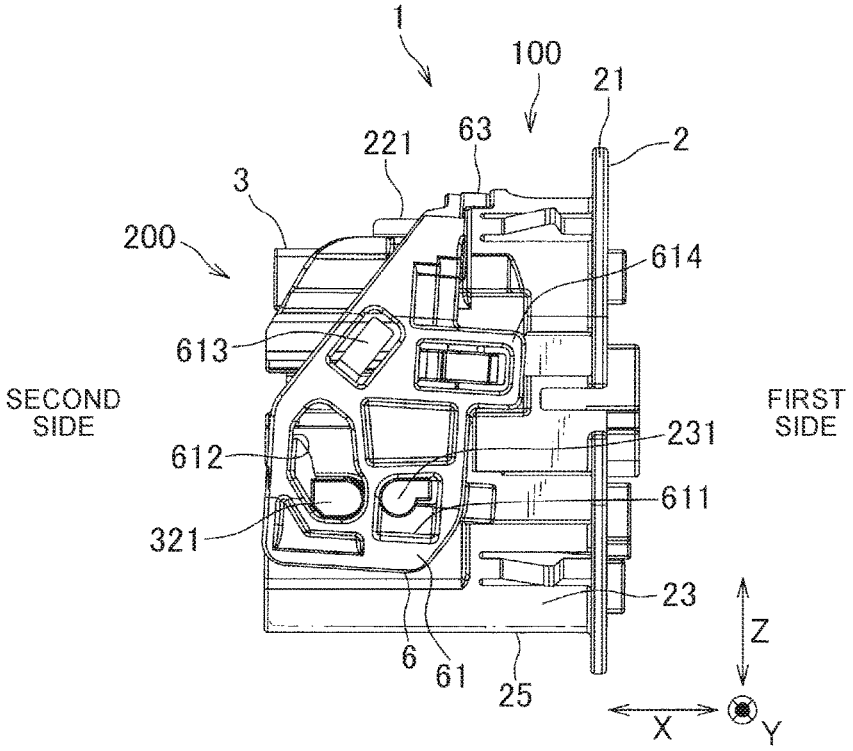
FIG. 10E is a side view of the connector unit in the fully fitted state.

When the lever member 6 is further rotated, the connecting portion 63 of the lever member 6 is latched on the lever lock portion 221 of the male outer housing 2, where the connector unit 1 is now in the fully fitted state, as shown in FIG. 10B. As shown especially in FIG. 10D, in the fully fitted state the arm portion 614B goes completely over the detection projection 232 and is latched. Further, the moving plate 7 is sandwiched by the male sub connector 4 and the female sub connector 5, and the terminal fitting provided to the male coaxial sub connector 8 and the terminal fitting provided to the female coaxial sub connector 9 abut each other and electrically connected each other.

The connector unit 1 assembled in a manner described above is attached to a pillar P1 as an object to be attached, as shown in FIG. 11A. That is, the connector unit 1 is inserted through an opening P0 of the pillar P1 from the end of the connector unit 1 on the second side in the X direction. The opening P0 is formed into a shape that follows the outer circumference of the connector unit 1 (oval, in the example shown), and has a size that allows the connector unit 1 in the fully fitted state to be inserted therethrough. The connector unit 1 is inserted through the opening P0 until the flange portion 21 of the male outer housing 2 abuts on the pillar P1.

By the way, there is a case in which the lever member 6 is insufficiently rotated during the assembling of the connector unit 1, failing to bring the connector unit 1 in the fully fitted state. The following will explain the action of the respective parts/elements of the connector unit 1 for the case of inserting the connector unit 1 in the provisional fit state through the opening P0.

Firstly, in the state before the fully fitted state (i.e., before the state in which the connecting portion 63 is latched on the male outer housing 2), the arm portions 614B, 624B of the detection arms 614, 624 is deformed outward as described above. Thus, the size in the Y direction of the connector unit 1 in the provisional fit state is larger than the opening size in the Y direction of the opening P0. Accordingly, when trying to insert the connector unit 1 in the provisional fit state through the opening P0, outer convex portions located on tip ends of the respective arm portions 614B, 624B will be caught by an inner edge of the opening P0, as shown in FIGS. 11A and 11B.

In this state with the arm portions 614B, 624B caught by the inner edge of the opening P0, if the operator tries to further insert the connector unit 1 with the force in the X direction, then the inward force in the Y direction is applied to the arm portions 614B, 624B extending in the X direction. As a result, the arm portions 614B, 624B are guided by the slanted face 232A and try to go over the detection projection 232, causing the lever member 6 to rotate. As shown in FIGS. 12A and 12B, once the arm portions 614B, 624B go completely over the detection projection 232, they are deformed inward due to the restoring force and return to the original shape. At substantially the same time, the connecting portion 63 of the lever member 6 is latched on the male outer housing 2, and the connector unit 1 will be in the fully fitted state.

This embodiment will provide the following advantageous effects. That is, by fitting the fitting portion 341 of the female outer housing 3 with the to-be-fitted portion 251 of the male outer housing 2, the operator can experience the change in the force required for the operation (i.e., the change in response or the change in feeling) while moving the female outer housing 3 closer to the male outer housing 2 and housing the female outer housing 3 in the male outer housing 2. At that time, since the timing of the fitting is substantially the same time as the timing at which the guide projection 321 is inserted to the guidable position in the guide groove 612, and the timing at which the restriction arm 613 is released by the release projection 322, the operator can rotate the lever member 6 after he experiences the change in feeling, thereby preventing damage to the respective parts/elements of the guide projection 321 and the restriction arm 613 and such. In other word, the operator can recognize, based on the change in feeling, that the lever member 6 is brought into a suitable state for rotation.

Furthermore, since the four side face portions 22-25 of the quadrangular tube-like shaped male outer housing 2 are provided with the function of pivotally supporting the plate portions 61, 62 of the lever member 6, the function of locking the connecting portion 63 and the function of fitting with the fitting portion 341, the respective face portions 22-25 can be downsized and simplified.

Furthermore, as described above, the arm portions 614B, 624B of the detection arm 614, 624 extend in the X direction (i.e., in the extending direction of the male outer housing 2) in the state before the connecting portion 63 is latched onto the male outer housing 2. Accordingly, when trying to insert the connector unit 1 through the opening P0 along the X direction, the inward force can be easily applied to the arm portions 614B, 624B, thus the arm portions 614B, 624B can easily be deformed inward and the lever member 6 can easily be rotated. Consequently, when attaching the connector unit 1 in the provisional fit state to the object P1 to be attached, damage to the arm portions 614B, 624B can be prevented. In addition, by inserting the connector unit 1 in the provisional fit state through the opening P0, the lever member 6 can be rotated and the connecting portion 63 can be latched onto the male outer housing 2, thereby the connector unit 1 can be brought into the fully fitted state.

Furthermore, since the detection projection 232 for deforming the arm portion 614B, 624B outward is provided with the slanted face 232A, the lever member 6 can be easily rotated upon application of the inward force to the arm portions 614B, 624B.

Furthermore, as described above, the detection opening 235 is formed on the male outer housing 2 as the outer housing, and the detection portion 412 is provided to the make sub connector 4 as the inner member. Thus, it is possible to determine that the housing is insufficiently completed if the detection portion 412 is seen through the detection opening 235, whereas it can be determined that the housing is sufficiently completed if the detection portion 412 is not seen through the detection opening 235.

The present invention is not limited to the above-described embodiment. The present invention may include other constitution which can achieve the object of the present invention, and it may include the modifications indicated below.

For example, in the embodiment described above, the male outer housing 2 is formed into the quadrangular tube-like shape, and the lever lock portion 221, the lever rotation shaft 231 and the to-be-fitted portion 251 are provided on different side face portions, respectively. However, the male outer housing is not limited to such constitution. That is, the male outer housing may be formed into a circular tube-like shape or a polyangular tube-like shape other than quadrangular tube-like shape. Further, the to-be-fitted portion may be provided onto the side face having the lever lock portion or the side face having the lever rotation shaft.

Furthermore, in the embodiment described above, the detection projection 232 is provided to the male outer housing 2 so that the arm portions 614B, 624B of the detection arm 614, 624 are deformed outward. However, other modifications are possible as long as the detection arm is arranged to be deformed inward when the connecting portion 63 is latched on the male outer housing 2. For example, it is possible to arrange such that the detection arm is deformed outward by attaching the lever member to the male outer housing, while the outer face of the male outer housing is provided with a concaved portion for receiving the tip end of the detection arm. That is, it may be arranged such that the detection arm is always deformed outward in a state other than the state in which the connecting portion 63 is latched on the male outer housing 2.

Furthermore, the detection arm may be omitted in the case where the change in feeling is large when the connecting portion 63 is latched on the male outer housing 2, and thus it is easy to determine that the connector unit is brought to the fully fitted state, or in the case where other means for detecting the fully fitted state, or in the case where the connector unit is not inserted through the opening, for example.

Furthermore, in the embodiment described above, the detection opening 235 is formed at the male outer housing 2 as the outer housing, and the detection portion 412 is provided to the male sub connector 4 as the inner member, as described above. However, the detection opening may be formed at the female outer housing as the outer housing, and the detection portion may be provided to the female sub connector as the inner member. Further, the detection portion may be formed into a concaved shape, and in this case also, it is possible to determine whether or not the housing amount is equal to the proper housing amount based on the insertable depth of the detection plate P in a manner similar to the embodiment described above. Further, the detection opening and the detection portion may be omitted in the case where the change in feeling is large when the sub connector is latched by the sub connector lock portion, and thus it is easy to determine that the housing amount has become equal to the proper housing amount, for example.

The preferred constitution and method for implementing the present invention have been disclosed, however the embodiments described herein are only representative embodiments of the present invention and are not intended to limit the present invention. That is, the shown embodiments can be modified or changed in various ways for shapes, materials, number and other detailed constitution without departing from the spirit and scope of the present invention. Terms regarding the shape or material used herein are used only for illustrative purpose and should not limit the present invention.

Second Invention

The present invention relates to a connector unit including a first housing, a second housing and a lever member.

Conventionally, a connector (connector unit) arranged to fit a pair of connector housings with each other using a lever (lever member) and arranged to be attached to a panel has been proposed, as disclosed for example in Japanese Patent Application Publication No. 2003-17190. The connector disclosed in Japanese Patent Application Publication No. 2003-17190 includes a pushing part projecting from a side face of one of the connector housings, such that a movable detection portion (detection arm) of the lever is deformed outward in a half-fitted state. Accordingly, when inserting the connector in the half-fitted state though an attachment hole of the panel, the movable detection portion interferes with an edge of the attachment hole, therefore it is possible to determine that the connector is in the half fitted state.

However, the connector disclosed in Japanese Patent Application Publication No. 2003-17190 has a drawback that, once the connector is determined to be in the half-fitted state, it is necessary to pull out the connector from the attachment hole, make the connector in the fully fitted state, and insert the connector through the attachment hole again, causing an increase in assembling man hour. Further, if the one tries to insert the connector in the half-fitted state through the attachment hole with a large force, the movable detection portion will be applied with large force, possibly causing plastic deformation. If the movable detection portion is plastically deformed, the connector cannot longer be inserted through the insertion hole even if the connector is brought into the proper fitted state.

An object of the present invention is to provide a connector unit which can prevent damage to a detection arm while decreasing assembling man hour.

A connector unit according to the present invention provides a connector unit including a tubular first housing, a second housing arranged to be housed in the first housing, and a lever member attached to an outer side of the first housing and arranged to fit the first housing with the second housing, wherein the lever member includes a pair of plate portions provided so as to sandwich the first housing, and a connecting portion connecting the pair of plate portions and arranged to be latched onto the first housing, wherein the plate portion includes an axis portion to be pivotally supported to the first housing, a guide groove for guiding the second housing, and a detection arm, wherein an outer face of the second housing is provided with a guide projection arranged to be guided by the guide groove, wherein the detection arm is arranged to extend along an extending direction of the tubular first housing in a state before the connecting portion is latched onto the first housing, and is arranged to be deformed inwardly when the connecting portion is latched onto to the first housing, and wherein the lever member is arranged to rotate such that, in the state before the connecting portion is latched onto the first housing, when an inward force is applied to the detection arm, the connecting portion is latched onto the first housing.

According to the connector unit described above, the connecting portion is latched onto the first housing and the detection arm is deformed inward, so the overall size (external dimensions) of the connector housing will change in accordance with whether or not the connecting portion is latched. Consequently, when trying to insert the connector housing through the opening of the object to be attached, the insertion is permitted if the connecting portion is latched, whereas the insertion is prohibited if the connecting portion is not latched because the detection arm is caught by an inner edge of the opening. In other word, if the first housing and the second housing are half-fitted with each other, the attachment of the connector unit to the object to be attached is prohibited.

Since the detection arm extends along the extending direction of the first housing, when trying to insert the connector unit through the opening along the extending direction, the inward force is likely to be applied to the detection arm, thus it is easy to deform the detection arm inward and rotate the lever member. Consequently, when trying to attach the connector unit in the provisional fit state (i.e., the state in which the connecting portion is not latched onto the first housing) to the object to be attached, the damage to the detection arm can be prevented. Furthermore, by inserting the connector unit in the provisional fit state through the opening, the lever member can be rotated and the connecting portion can be latched onto the first housing, thereby bringing the connector unit into the fully fitted state (i.e., the state in which the connecting portion is latched onto the first housing). Therefore, the assembling man hour can be decreased for the case when the connector unit in the provisional fit state is to be inserted.

It is preferable that, a detection projection is provided on an outer face of the first housing, wherein the detection projection is arranged to deform the detection arm outward in the state before the connecting portion is latched onto the first housing, wherein the detection projection includes a slanted face slanted outward as it gets toward a distal end side of the detection arm from a proximal end side of the detection arm, wherein the lever member is arranged such that, in the state before the connecting portion is latched onto the first housing, when the inward force is applied to the detection arm, the detection arm is guided by the slanted face and goes over the detection projection, thereby allowing the lever member to rotate.

According to the constitution described above, since the detection projection which deforms the detection arm outward is provided with the slanted face, the lever member can easily be rotated when the inward force is applied onto the detection arm.

According to the connector unit described above, the detection arm extends along the extending direction of the first housing, and the lever member is arranged to rotate upon application of the inward force onto the detection arm. Consequently, the damage of the detection arm can be prevented, and the assembling man hour can be decreased.

An exemplary embodiment of the second invention is similar to that of the first invention.

Third Invention

The present invention relates to a connector including a tubular outer housing and an inner member to be housed in a housing portion of the outer housing.

Conventionally, a split connector including a holder (outer housing) having a tubular sub connector housing portion and a sub connector (inner member) arranged to be housed in the sub connector housing portion has been proposed, as disclosed for example in Japanese Patent Application Publication No. 2003-17190. In the split connector disclosed in Japanese Patent Application Publication No. 2003-17190, a detection notch is formed on a side face portion of the holder, and an penetrating notch is formed on a side face portion of the sub connector, such that the detection notch is continuous with the penetrating notch when the sub connector is inserted to a proper position. By inserting a detection pin through the detection notch and the penetrating notch, it is possible to determine whether or not the sub connector has been inserted to the proper position.

However, when determining the position of the sub connector by inserting the detection pin as disclosed in Japanese Patent Application Publication No. 2003-17190, the detection pin may be deformed due to the application of force onto the detection pin from the direction other than the insertion direction. Further, since the detection notch and the penetrating notch are extending in an in-plane direction of the side face portion, if the diameter of the detection pin is increased, the thicknesses of the side face portions of the holder and the sub connector are also increased, making it difficult to improve the strength of the detection pin to prevent the deformation thereof. Thus, to prevent the deformation of the detection pin, it is necessary to precisely control the magnitude and direction of the force to be applied to the detection pin, therefore it is desirable to easily determine the position of the sub connector.

An object of the present invention is to provide a connector which allows to easily determine whether or not a housing amount of an inner member within an outer housing is equal to a proper housing amount.

A connector according to the present invention includes a tubular outer housing, and an inner member arranged to be housed in a housing portion of the outer member, wherein a side face portion of the outer housing is provided with a detection opening through which the housing portion can be seen from outside, wherein a concaved or convexed detection portion is provided on an outer face of the inner member, wherein the inner member is arranged to be latched onto the outer housing when a housing amount within the outer housing becomes equal to a proper housing amount, and wherein the detection portion is arranged such that, when the housing amount is less than the proper housing amount, the detection portion can be seen through the detection opening, whereas when the housing amount becomes equal to the proper housing amount, the detection portion is hidden by the side face portion of the outer housing and cannot be seen.

According to the connector described above, it can be determined that the housing is not sufficient if the detection portion can be seen through the detection opening, whereas it can be determined that the housing is sufficient if the detection portion cannot be seen. At this time, a jig may be inserted in the detection opening to determine whether the detection portion is in the state in which it can be seen or not, according to the depth of insertion.

Furthermore, since the detection opening is formed at the side face portion of the outer housing so the housing portion can be seen from outside, the detection opening can be designed in a suitable size. Thus, when inserting the jig into the detection opening as described above, the jig with a suitable size can be used, thus it is easy to keep the strength of the jig. Consequently, there is no need to accurately control the insertion force or the insertion direction of the jig, allowing it easy to determined whether or not the housing amount of the inner member in the outer housing is equal to the proper housing amount.

According to the connector described above, the detection opening is formed on the side face portion of the outer housing, and the concaved or convexed detection portion is provided to the outer face of the inner member. Consequently, it is easy to determine whether or not the housing amount of the inner member within the outer housing is equal to the proper housing amount.

An exemplary embodiment of the third invention is similar to that of the first invention.

REFERENCE SIGN LIST

1 connector unit
2 male outer housing (first housing, outer housing)
22-25 side face portion
232 detection projection
232A slanted face
235 detection opening
251 to-be-fitted portion
3 female outer housing (second housing)
321 guide projection
322 release projection
341 fitting portion
4 male sub connector (inner member)
412 detection portion
6 lever member
61, 62 plate portion
611 axis portion
612 guide groove
613 restriction arm
614 detection arm
63 connecting portion

What is claimed is:

1. A connector unit comprising
a tubular first housing;
a second housing arranged to be housed in the first housing; and
a lever member attached to an outer side of the first housing and arranged to fit the first housing with the second housing,
wherein the lever member includes
a pair of plate portions provided so as to sandwich the first housing, and a connecting portion connecting the pair of plate portions and arranged to be latched onto the first housing, wherein the plate portion includes an axis portion to be pivotally supported to the first housing, a guide groove for guiding the second housing, and a restriction arm arranged to abut on the first housing to restrict rotation of the lever member around the axis portion, wherein an outer face of the second housing is provided with a guide projection arranged to be guided by the guide groove, a release projection which releases the restriction arm by deforming the restriction arm outward, and a fitting portion arranged to be fitted with a to-be-fitted portion of the first housing, and wherein, during the second housing is being housed in the first housing, the guide projection is inserted to a guidable position of the guide groove, and after the restriction arm is released by the release projection, the fitting portion of the second housing is fitted with the to-be-fitted portion of the first housing.

2. The connector unit as claimed in claim 1, wherein the first housing is formed into a quadrangular tube-like shape with a pair of side face portions arranged to pivotally support the plate portions, a side face portion arranged to latch the connecting portion, and a side face portion provided with the to-be-fitted portion.

3. The connector unit as claimed in claim 1, wherein the plate portion is provided with a detection arm, wherein the detection arm is arranged to extend along an extending direction of the tubular first housing in a state before the connecting portion is latched onto the first housing, and is arranged to be deformed inwardly when the connecting portion is latched onto to the first housing, and wherein the lever member is arranged to rotate such that, in the state before the connecting portion is latched onto the first housing, an inward force is applied to the detection arm whereby the connecting portion is latched onto the first housing.

4. The connector unit as claimed in claim 2, wherein the plate portion is provided with a detection arm, wherein the detection arm is arranged to extend along an extending direction of the tubular first housing in a state before the connecting portion is latched onto the first housing, and is arranged to be deformed inwardly when the connecting portion is latched onto to the first housing, and wherein the lever member is arranged to rotate such that, in the state before the connecting portion is latched onto the first housing, an inward force is applied to the detection arm whereby the connecting portion is latched onto the first housing.

5. The connector unit as claimed in claim 3, wherein a detection projection is provided on an outer face of the first housing, wherein the detection projection is arranged to deform the detection arm outward in the state before the connecting portion is latched onto the first housing, wherein the detection projection includes a slanted face slanted outward as it gets toward a distal end side of the detection arm from a proximal end side of the detection arm, wherein the lever member is arranged such that, in the state before the connecting portion is latched onto the first housing, when the inward force is applied to the detection arm, the detection arm is guided by the slanted face and goes over the detection projection, thereby allowing the lever member to rotate.

6. The connector unit as claimed in claim 4, wherein a detection projection is provided on an outer face of the first housing, wherein the detection projection is arranged to deform the detection arm outward in the state before the connecting portion is latched onto the first housing, wherein the detection projection includes a slanted face slanted outward as it gets toward a distal end side of the detection arm from a proximal end side of the detection arm, wherein the lever member is arranged such that, in the state before the connecting portion is latched onto the first housing, when the inward force is applied to the detection arm, the detection arm is guided by the slanted face and goes over the detection projection, thereby allowing the lever member to rotate.

7. The connector unit as claimed in claim 1, wherein at least one of the first housing and the second housing is a tubular outer housing having a housing portion for housing an inner member, wherein a side face portion of the outer housing is provided with a detection opening through which the housing portion can be seen from outside, wherein a concaved or convexed detection portion is provided on an outer face of the inner member, wherein the inner member is arranged to be latched onto the outer housing when a housing amount within the outer housing becomes equal to a proper housing amount, and wherein the detection portion is arranged such that, when the housing amount is less than the proper housing amount, the detection portion can be seen through the detection opening, whereas when the housing amount becomes equal to the proper housing amount, the detection portion is hidden by the side face portion of the outer housing and cannot be seen.

8. The connector unit as claimed in claim 2, wherein at least one of the first housing and the second housing is a tubular outer housing having a housing portion for housing an inner member, wherein a side face portion of the outer housing is provided with a detection opening through which the housing portion can be seen from outside, wherein a concaved or convexed detection portion is provided on an outer face of the inner member, wherein the inner member is arranged to be latched onto the outer housing when a housing amount within the outer housing becomes equal to a proper housing amount, and wherein the detection portion is arranged such that, when the housing amount is less than the proper housing amount, the detection portion can be seen through the detection opening, whereas when the housing amount becomes equal to the proper housing amount, the detection portion is hidden by the side face portion of the outer housing and cannot be seen.

9. The connector unit as claimed in claim 3, wherein at least one of the first housing and the second housing is a tubular outer housing having a housing portion for housing an inner member, wherein a side face portion of the outer housing is provided with a detection opening through which the housing portion can be seen from outside, wherein a concaved or convexed detection portion is provided on an outer face of the inner member, wherein the inner member is arranged to be latched onto the outer housing when a housing amount within the outer housing becomes equal to a proper housing amount, and wherein the detection portion is arranged such that, when the housing amount is less than the proper housing amount, the detection portion can be seen through the detection opening, whereas when the housing amount becomes equal to the proper housing amount, the detection portion is hidden by the side face portion of the outer housing and cannot be seen.

10. The connector unit as claimed in claim 4, wherein at least one of the first housing and the second housing is a tubular outer housing having a housing portion for housing an inner member, wherein a side face portion of the outer housing is provided with a detection opening through which the housing portion can be seen from outside, wherein a concaved or convexed detection portion is provided on an outer face of the inner member, wherein the inner member is arranged to be latched onto the outer housing when a housing amount within the outer housing becomes equal to a proper housing amount, and wherein the detection portion is arranged such that, when the housing amount is less than the proper housing amount, the detection portion can be seen through the detection opening, whereas when the housing amount becomes equal to the proper housing amount, the detection portion is hidden by the side face portion of the outer housing and cannot be seen.

11. The connector unit as claimed in claim 5, wherein at least one of the first housing and the second housing is a tubular outer housing having a housing portion for housing an inner member, wherein a side face portion of the outer housing is provided with a detection opening through which the housing portion can be seen from outside, wherein a concaved or convexed detection portion is provided on an outer face of the inner member, wherein the inner member is arranged to be latched onto the outer housing when a housing amount within the outer housing becomes equal to a proper housing amount, and wherein the detection portion is arranged such that, when the housing amount is less than the proper housing amount, the detection portion can be seen through the detection opening, whereas when the housing amount becomes equal to the proper housing amount, the detection portion is hidden by the side face portion of the outer housing and cannot be seen.

12. The connector unit as claimed in claim 6, wherein at least one of the first housing and the second housing is a tubular outer housing having a housing portion for housing an inner member, wherein a side face portion of the outer housing is provided with a detection opening through which the housing portion can be seen from outside, wherein a concaved or convexed detection portion is provided on an outer face of the inner member, wherein the inner member is arranged to be latched onto the outer housing when a housing amount within the outer housing becomes equal to a proper housing amount, and wherein the detection portion is arranged such that, when the housing amount is less than the proper housing amount, the detection portion can be seen through the detection opening, whereas when the housing amount becomes equal to the proper housing amount, the detection portion is hidden by the side face portion of the outer housing and cannot be seen.

* * * * *